US011092150B2

(12) United States Patent
Marsh

(10) Patent No.: US 11,092,150 B2
(45) Date of Patent: Aug. 17, 2021

(54) MICRO PUMP SYSTEMS AND PROCESSING TECHNIQUES

(71) Applicant: Encite LLC, Burlington, MA (US)

(72) Inventor: Stephen Alan Marsh, Carlisle, MA (US)

(73) Assignee: Encite LLC, Burlington, MA (US)

( * ) Notice: Subject to any disclaimer, the term of this patent is extended or adjusted under 35 U.S.C. 154(b) by 361 days.

(21) Appl. No.: 15/917,905

(22) Filed: Mar. 12, 2018

(65) Prior Publication Data

US 2018/0258923 A1 Sep. 13, 2018

Related U.S. Application Data

(60) Provisional application No. 62/470,460, filed on Mar. 13, 2017.

(51) Int. Cl.

| | |
|---|---|
| ***F04B 43/02*** | (2006.01) |
| ***F04B 43/14*** | (2006.01) |
| ***F04B 43/04*** | (2006.01) |
| ***F04B 43/00*** | (2006.01) |
| ***F04B 45/04*** | (2006.01) |
| ***F04B 45/047*** | (2006.01) |

(52) U.S. Cl.

CPC ..... *F04B 43/026* (2013.01); *F04B 43/0027* (2013.01); *F04B 43/0045* (2013.01); *F04B 43/023* (2013.01); *F04B 43/043* (2013.01); *F04B 43/14* (2013.01); *F04B 45/041* (2013.01); *F04B 45/043* (2013.01); *F04B 45/047* (2013.01)

(58) Field of Classification Search

CPC ..... F04B 19/006; F04B 23/04; F04B 23/06; F04B 7/00; F04B 7/0076; F04B 45/04; F04B 45/041; F04B 45/043; F04B 43/023; F04B 43/025; F04B 43/026; F04B 43/0027; F04B 43/0045; F04B 43/043; F04B 45/047; F04B 43/12; F04B 43/14; F04B 45/00

USPC ..... 417/413.1–413.3

See application file for complete search history.

(56) References Cited

U.S. PATENT DOCUMENTS 5,267,841 A * 12/1993 Culp ..... F02K 9/46 417/322

5,687,767 A 11/1997 Bowers (Continued)

FOREIGN PATENT DOCUMENTS

CN 1354823 A 6/2002
CN 1378041 A 11/2002

(Continued)

OTHER PUBLICATIONS

International Search Report, PCT/US18/21952.

(Continued)

*Primary Examiner* — Philip E Stimpert

(74) *Attorney, Agent, or Firm* — Fish & Richardson P.C.

(57) ABSTRACT

Disclosed is a valve-less micro pump configuration that includes plural micro pump elements, each including a pump body having a compartmentalized pump chamber, with plural unobstructed inlet ports and outlet ports and a plurality of membranes disposed in the pump chamber to provide compartments. The membranes are anchored between opposing walls of the pump body and carry electrodes disposed on opposing surfaces of the membranes and walls of the pump body.

21 Claims, 20 Drawing Sheets

(56) References Cited

U.S. PATENT DOCUMENTS

| | | | | |
|---|---|---|---|---|
| 5,836,750 | A | 11/1998 | Cabuz | |
| 6,106,245 | A | 8/2000 | Cabuz | |
| 6,179,586 | B1 | 1/2001 | Herb et al. | |
| 6,247,908 | B1 | 6/2001 | Shinohara et al. | |
| 6,261,066 | B1 | 7/2001 | Linnemann | |
| 6,435,840 | B1 * | 8/2002 | Sharma | F04B 43/082 417/322 |
| 6,443,154 | B1 | 9/2002 | Jalde | |
| 6,568,286 | B1 | 5/2003 | Cabuz | |
| 6,758,107 | B2 | 7/2004 | Cabuz | |
| 6,889,567 | B2 | 5/2005 | Cabuz | |
| 7,090,471 | B2 | 8/2006 | Xie et al. | |
| 7,802,970 | B2 | 9/2010 | Singhal et al. | |
| 8,308,452 | B2 | 11/2012 | Amirouche et al. | |
| 8,841,820 | B2 * | 9/2014 | Bennett | F04B 17/003 310/328 |
| 2002/0029814 | A1 | 3/2002 | Unger et al. | |
| 2002/0127736 | A1 * | 9/2002 | Chou | F04B 11/00 436/180 |
| 2003/0068231 | A1 | 4/2003 | Cabuz et al. | |
| 2003/0106799 | A1 | 6/2003 | Covington et al. | |
| 2003/0231967 | A1 | 12/2003 | Najafi et al. | |
| 2004/0077074 | A1 | 4/2004 | Ackley et al. | |
| 2004/0103899 | A1 | 6/2004 | Noble | |
| 2004/0115068 | A1 | 6/2004 | Hansen et al. | |
| 2004/0253123 | A1 | 12/2004 | Xie et al. | |
| 2007/0020124 | A1 | 1/2007 | Singhal et al. | |
| 2007/0085449 | A1 | 4/2007 | Boey et al. | |
| 2008/0150210 | A1 | 12/2008 | Boden et al. | |
| 2009/0074595 | A1 | 3/2009 | Chen et al. | |
| 2009/0129952 | A1 | 5/2009 | Patrascu et al. | |
| 2009/0130607 | A1 | 5/2009 | Slafer | |
| 2010/0181871 | A1 | 7/2010 | Daniel et al. | |
| 2011/0150667 | A1 | 6/2011 | Bernstein | |
| 2011/0207328 | A1 | 8/2011 | Speakman | |
| 2012/0304993 | A1 * | 12/2012 | Nitta | F04B 43/043 128/204.18 |
| 2013/0020403 | A1 | 1/2013 | Bennett et al. | |
| 2013/0032210 | A1 | 2/2013 | Johnstone et al. | |
| 2013/0046330 | A1 | 4/2013 | Kabasawa et al. | |
| 2013/0287613 | A1 | 10/2013 | Gould et al. | |
| 2014/0147346 | A1 | 5/2014 | Chitnis et al. | |
| 2015/0267695 | A1 * | 9/2015 | Marsh | F16K 1/18 128/205.24 |
| 2016/0131126 | A1 | 5/2016 | Marsh | |
| 2018/0015247 | A1 | 1/2018 | Marsh | |

FOREIGN PATENT DOCUMENTS

| | | |
|---|---|---|
| CN | 102678528 A | 9/2012 |
| WO | WO2016/069988 | 5/2016 |

OTHER PUBLICATIONS

JP Official Action in JP Appln. No. 2016-572361 dated Jan. 4, 2019, 11 pages.

http://www.murata-ps.com/emena/2012-05-22.html, 2 pg.

PCT International Search Report & Written Opinion (PCT/US2015/017973).

European Search Report, PCT/US2018/021952, dated Mar. 26, 2020, p. 1-7.

Chinese Office Action, Appln. No. 2018/80030120.2, dated Feb. 26, 2021, p. 1-21.

* cited by examiner

MICRO PUMP SYSTEMS AND PROCESSING TECHNIQUES

CLAIM OF PRIORITY

This application claims priority under 35 U.S.C. § 119(e) to provisional U.S. Patent Application 62/470,460, filed on Mar. 13, 2017, entitled: "Micro Pump Systems and Processing Techniques" the entire contents of which are hereby incorporated by reference.

BACKGROUND

This specification relates to micro-based systems and more particularly to micro pump systems/devices.

Mechanical pump systems and compressor systems are well-known. Pumps are used to move fluid (such as liquids or gases or slurries) by mechanical action. Pumps can be classified according to the method used to move the fluid, e.g., a direct lift pump, a displacement pump, a peristaltic pump, and a gravity pump. Micro pumps are now also known. One example of a micro pump is described in my published application US-2015-0267695-A1, published Sep. 24, 2015 filed Feb. 26, 2015 the entire contents of which are incorporated herein by reference. Techniques for fabricating such micro pumps are also disclosed in the above mentioned published application. Also disclosed in my published application US-2016-0131126-A1, published May 12, 2016 and filed Oct. 29, 2015 the entire contents of which are incorporated herein by reference, are additional micro pump examples, exemplary applications and micro-electromechanical systems (MEMS) fabrication techniques including roll to roll processing.

SUMMARY

Described are peristaltic micro pump systems. Exemplary techniques to fabricate such peristaltic micro pump systems include using lithographic etching and patterning techniques as well as roll to roll fabrication techniques.

The described peristaltic micro pump systems are provided by cascade connecting individual micro pump units. These units do not include internal, fixed inlet and outlet valve members/structures such as those disclosed in the above applications. By operating the individual micro pump units in a phased sequence, such operation can effectively provide inlet and outlet isolation functions, thus obviating the need for fixed internal inlet valve structures and outlet valve structures.

According to an aspect, a micro pump includes a plurality of micro pump elements, each micro pump element including a pump body having walls that enclose a pump chamber that is compartmentalized into plural compartments, a plurality of inlet ports each with unobstructed fluid ingress into corresponding ones of the plural compartments and a plurality of outlet ports each with unobstructed fluid egress from corresponding ones of the plural compartments, a plurality of membranes disposed in the pump chamber, with the plurality of membranes affixed to the walls of the pump body, and which compartmentalized the chamber to provide the plural compartments, and a plurality of electrodes, with a first pair of the plurality of electrodes disposed on a pair of opposing walls of the pump body, and each of the remaining ones of the plurality of electrodes disposed on a major surface of a corresponding one of the plurality of membranes, with the plurality of micro pump elements arranged in a series connected configuration that has outlets of a first one of the plurality of micro pump elements fluidly connected to inlets of an immediately adjacent one of the plurality of micro pump elements.

Other aspects include methods of manufacture and methods of use.

The details of one or more embodiments of the invention are set forth in the accompanying drawings and the description below. Other features, objects, and advantages of the invention are apparent from the description and drawings, and from the claims.

DETAILED DESCRIPTION

Figure 1:
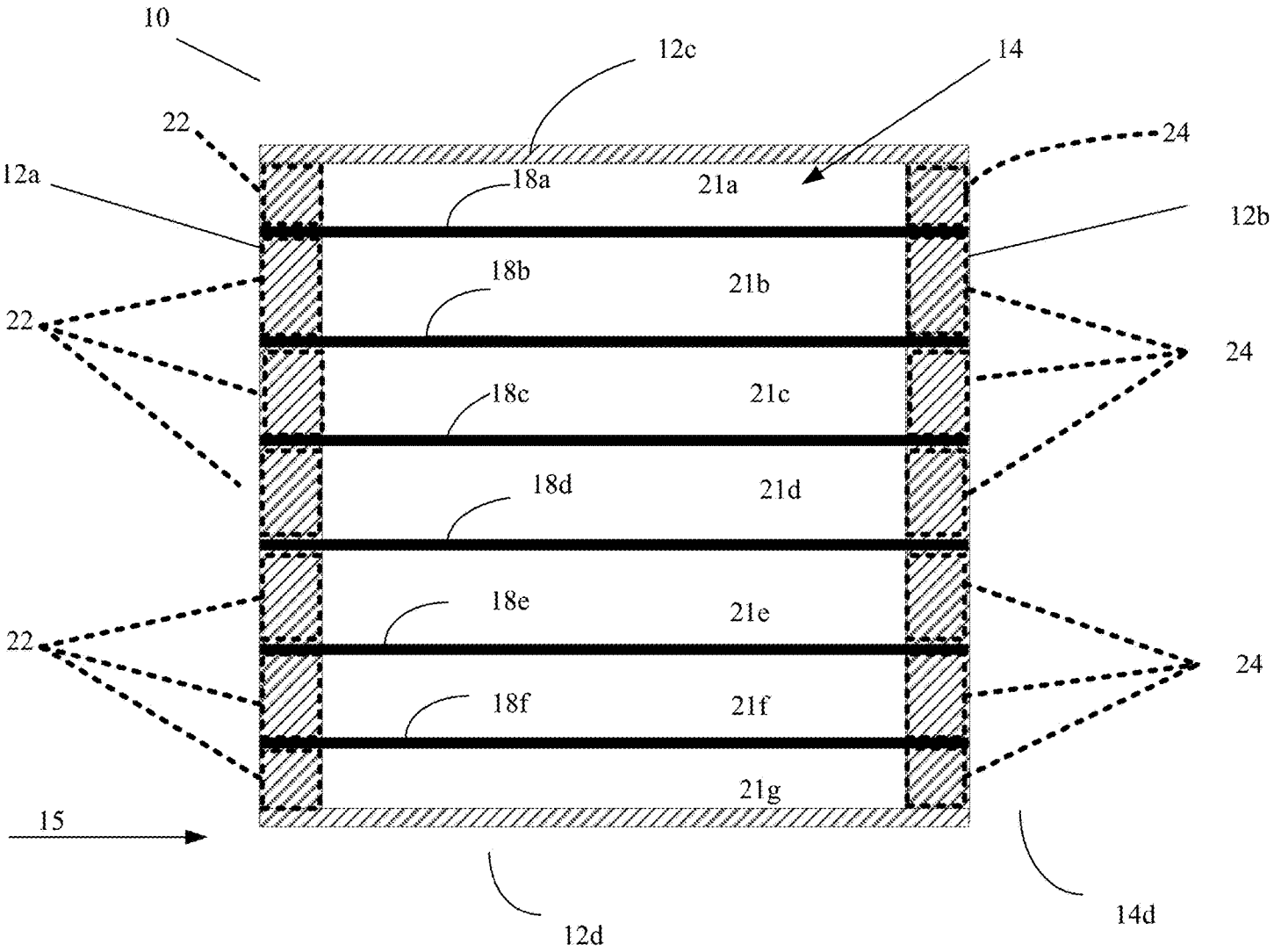
FIG. 1 is an assembled cross-sectional view of a valve less micro pump element.

Referring now to FIG. 1, a micro pump stack element 10 includes a pump body 12 enclosing a single, compartmentalized pump chamber 14. The pump body 12 is defined by two fixed walls 12*a*, 12*b* and two fixed end walls 12*c*, 12*d* opposite to each other and along a direction perpendicular to the two walls 12*a*, 12*b*. There are also two opposing walls (not shown in FIG. 1, which are orthogonal to fixed walls 12*a*, 12*b* and fixed end walls 12*c*, 12*d*, all of which together form a cube-like structure.)

The pumping direction is shown by arrow 15. However, as explained below, the pump direction is dynamically reversible. That is, as will be discussed below the designation of ports as inlets or outlets is with respect to drive sequences. The walls 12*a*, 12*b*, 12*c* and 12*d*, and the two walls (not shown) of the pump body define the single chamber 14. The single chamber 14 is compartmentalized by membranes 18*a*-18*f* that are anchored or affixed to two opposing walls, e.g., the two walls 12*c*, 12*d* (also referred to herein as endcaps 12*c*, 12*d*). The membranes 18*a*-18*f* are disposed to extend from the wall 12*a* to the wall 12*b* and the two walls that are not shown in this view. The membranes 18*a*-18*f* separate the pump chamber 14 into seven compartments 21*a*-21*g*. (In an implementation, the walls 12*a*, 12*b*, 12*c* and 12*d* of the pump body are provided by stacking of micro pump modules as will be discussed below.)

In this implementation, each compartment 21*a*-21*g* includes a pair of ports 22, 24. For discussion purposes, an inlet is generally designated as 22 and an outlet is generally designated as 24. These ports 22, 24 are illustrated in phantom in FIG. 1, as the ports are not visible in the cross-sectional view of FIG. 1. These ports 22, 24 are passages through the walls 12*a*, 12*b*, and more particularly an absence of portions of the walls 12*a*, 12*b*, respectively. The ports 22, 24 can be either input ports or output ports according to a pump drive sequence that is used. Throughout this discussion inlets or inputs are referred to by the number 22 and outlets or outputs are referred to by the number 24.

For example, the compartment 21*a* includes inlet 22 in the wall 12*a* and outlet 24 in the wall 12*b*, with the compartment 21*a* being defined by a portion of the wall 12*a*, the wall (or endcap) 12*c*, a portion of the wall 12*b*, the two walls (not shown in FIG. 1), and the membrane 18*a*. Other inlets and outlets are also labeled 22 and 24 respectively and other ones of the compartments 21*b*-21*g* are defined similarly.

The compartment 21*g* (like compartment 21*a*) at the opposite end of the pump chamber 14 is defined by the fixed wall (or endcap) 12*d* of the pump body 12, the two walls (not shown), and the corresponding membrane 18*f*. All intermediate compartments 21*b*-21*f* between the compartments 21*a*, 21*g* have walls formed by two membranes and corresponding portions of the walls 12*a* and 12*b* and the two walls (not shown). In some embodiments of the micro pump stack element 10, there is at least one intermediate compartment defined by portions of walls 12*a*, 12*b* and two membranes. Although six membranes (and five intermediate compartments) are shown in the figures, the pump chamber can be extended or reduced with additional or fewer intermediate compartments. The compartments 21*a*-21*g* are fluidically isolated from each other.

An electrode (not explicitly shown in FIG. 1 to FIG. 1F, but which will be discussed in FIGS. 2, 2A, and FIGS. 3-5) is attached to one side of each of the membranes 18*a*-18*g* and optionally to the end walls 12*c*, 12*d*. The electrodes are connected to a drive circuit (see FIG. 8) that delivers voltages to the electrodes to activate the respective membranes, e.g., causing flexing of the membranes, through electrostatic attraction/repulsion.

Without activation, the membranes rest at nominal positions as shown in FIG. 1. Each membrane at rest can be substantially parallel to the end walls 12*c*, 12*d* and the compartments 21*b*-21*f* can have the same nominal volume $V_i$. In some implementations, the compartments 21*a* and 21*g* each have the same nominal volume $V_j$, which is about half of the nominal volume $V_i$. For example, the distance between two adjacent membranes in their nominal positions is about 50 microns, and the nominal volume $V_i$ can range from nanoliters to microliters to milliliters, e.g., 0.1 microliters.

In the implementations, where the compartments 21*a*, 21*g* each have the nominal volume $V_j$ that is half the nominal volume of the intermediate compartments 21*b*-21*f*, the distance between the membrane 18*a*, 18*g* in their nominal positions and the end walls 12*c* or 12*d* is about 25 microns. The nominal volume can range from nanoliters to microliters to milliliters, e.g., 0.05 microliters. The compartments can also have different dimensions. The dimensions are chosen based on, e.g., specific process requirements, as well as, power consumption, application considerations and so forth.

For example, the compartments 21*a*, 21*b* having a width of 25 microns can allow a start-up function with a reduced peak drive voltage. Drive voltages are discussed further below. As an example, the micro pump element 10 can have an internal volume having a length of about 1.5 mm, a width of about 1.5 mm, a total height (the cumulative height of different compartments) of 0.05 mm, and a total volume of about 0.1125 μl.

One application of the micro pump element 10 is as a basic unit to build a series connected micro pump of which a peristaltic micro pump is a specific example, all of which is discussed in FIG. 2 (below).

Figures 1A, 1B, 1C:
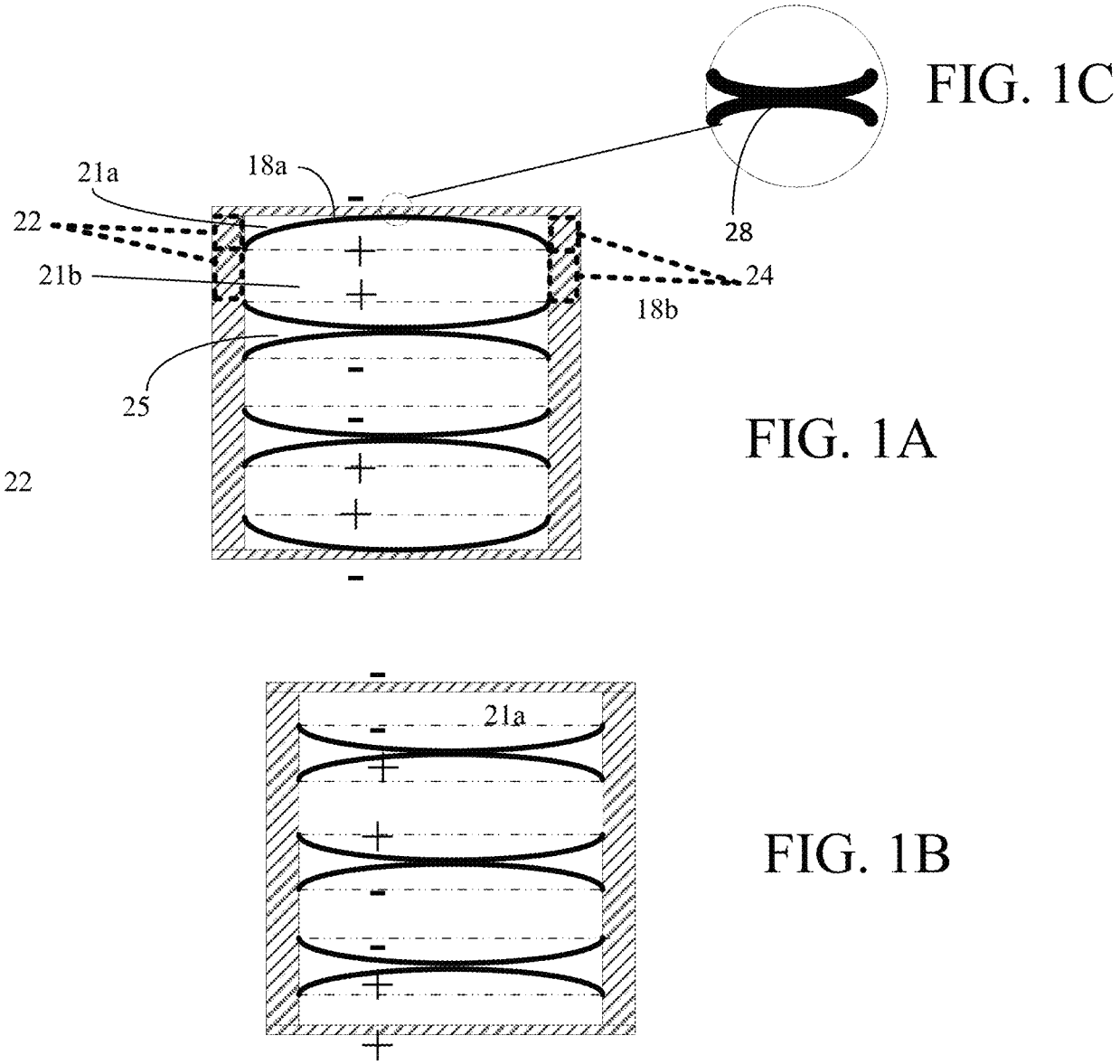
FIGS. 1A and 1B are cross-sectional views (somewhat simplified) of the micro pump element of FIG. 1 showing membrane actuations.
FIG. 1C is a blown-up view of a portion of FIG. 1A.

FIGS. 1A and 1B show two operational states of the micro pump stack element 10. When actuated, each membrane of the pump chamber flexes in one of two opposite directions about a central, nominal location at which the membrane is at a rest state when it is not actuated, according to polarities of voltages provided to electrodes (not shown) on membranes and endcaps. The rest positions of the membranes are shown in phantom dotted lines in each of FIGS. 1A and 1B.

Voltages are applied to the membranes 18*a*-18*f* according to a sequence. In response to a one portion of such as sequence, a compartment, e.g., compartment 21*a*, is compressed when the adjacent membrane 18*a* defining that compartment moves towards the endcap 12*c* (see FIG. 1A) carrying an electrode (not shown), reducing the volume of the compartment 21*a* and isolating the compartment 21*a* via a seal 28 (where the membrane 18*a* contacts the endcap 12*c*) to discharge a fluid, e.g., a gas or a liquid from the compartment 21*a*. The membrane 18*a* and endcap 12*c* form a seal that isolates one of the ports (generally 22 shown in phantom) from the opposite ports (generally 24 shown in phantom), as shown in FIG. 1C. Simultaneous to the compression of that compartment, e.g., 21*a*, the immediately adjacent compartment, e.g., compartment 21*b*, is charged when its two membranes 18*a* and 18*b* move away from each other to expand the compartment 21*b* volume (see FIG. 1A) that removes a seal that had isolated, e.g., port 22 (shown in phantom) from the port 24 (shown in phantom), in a previous sequence of application of the voltages.

FIG. 1B shows a second operational state of the membranes when voltage polarities are changed. Ports are not illustrated. The membranes are illustrated but not referenced.

As shown in FIGS. 1, 1A-1B the walls of the pump body are perpendicular to the nominal resting positions (see FIG. 1) of the membranes. However, if the walls of the pump body are perpendicular, there may exist small void spaces 25 (e.g., FIG. 1A) between the walls of the pump body and membranes, as shown in FIGS. 1A-1B. Within this void 25 could reside a small amount of the fluid being pumped by the micro pump 10. This fluid would remain each cycle as the fluid is pumped by the micro pump, and thus the presence of the voids 25 may represent a loss in pumping efficiency.

Figure 1F:
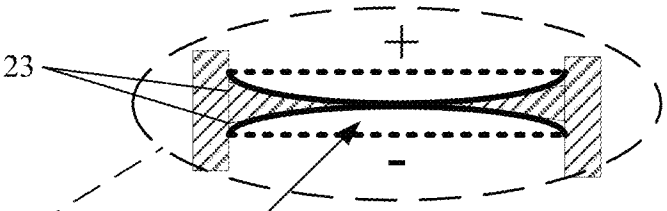
FIG. 1F is a blown-up view of a portion of FIG. 1D.
Figure 1D:
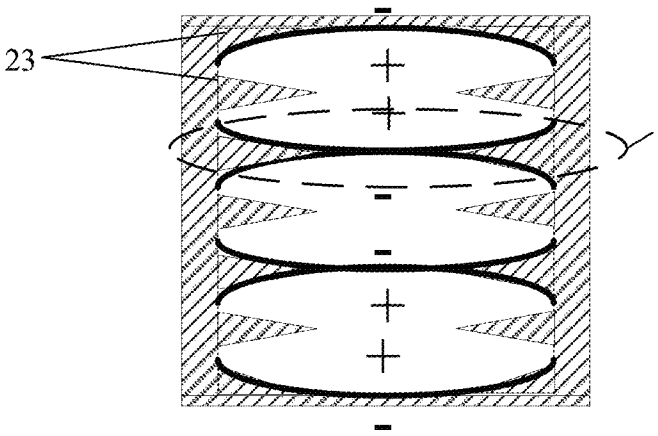
FIGS. 1D and 1E are cross-sectional views of an alternative configuration of a micro pump element having tapered sidewalls for pump compartments, and showing membrane actuations.
Figure 1E:
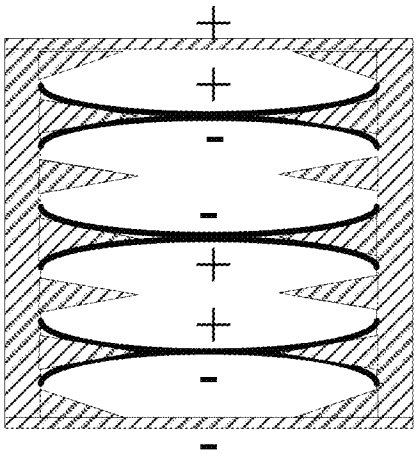

Referring now to FIGS. 1D-1E, in order to alleviate the potential loss caused by voids 25, the walls of the pump body could be configured to gradually taper (either a straight line taper, as shown or a curved line taper) having a generally equilateral triangular, solid shape into the chamber as shown in FIGS. 1D-1F to substantially fill the voids 25 (e.g., eliminate the voids shown in FIGS. 1A-1B). The walls of the pump body 12 can be of a shape 23, e.g., a wedge-shape, that will occupy any space that would remain after a membrane flexed in response to application of voltages. That is, upon application of voltage to the electrodes, electrostatic attraction of membranes having opposite electrostatic charges will have the membranes initially touch in the middle and subsequently cause the membranes to "zipper" together as the attraction force towards each other causes the membranes to further flex and fully seal against the tapered portions of the pump body walls and surfaces of the membrane.

Figure 2:
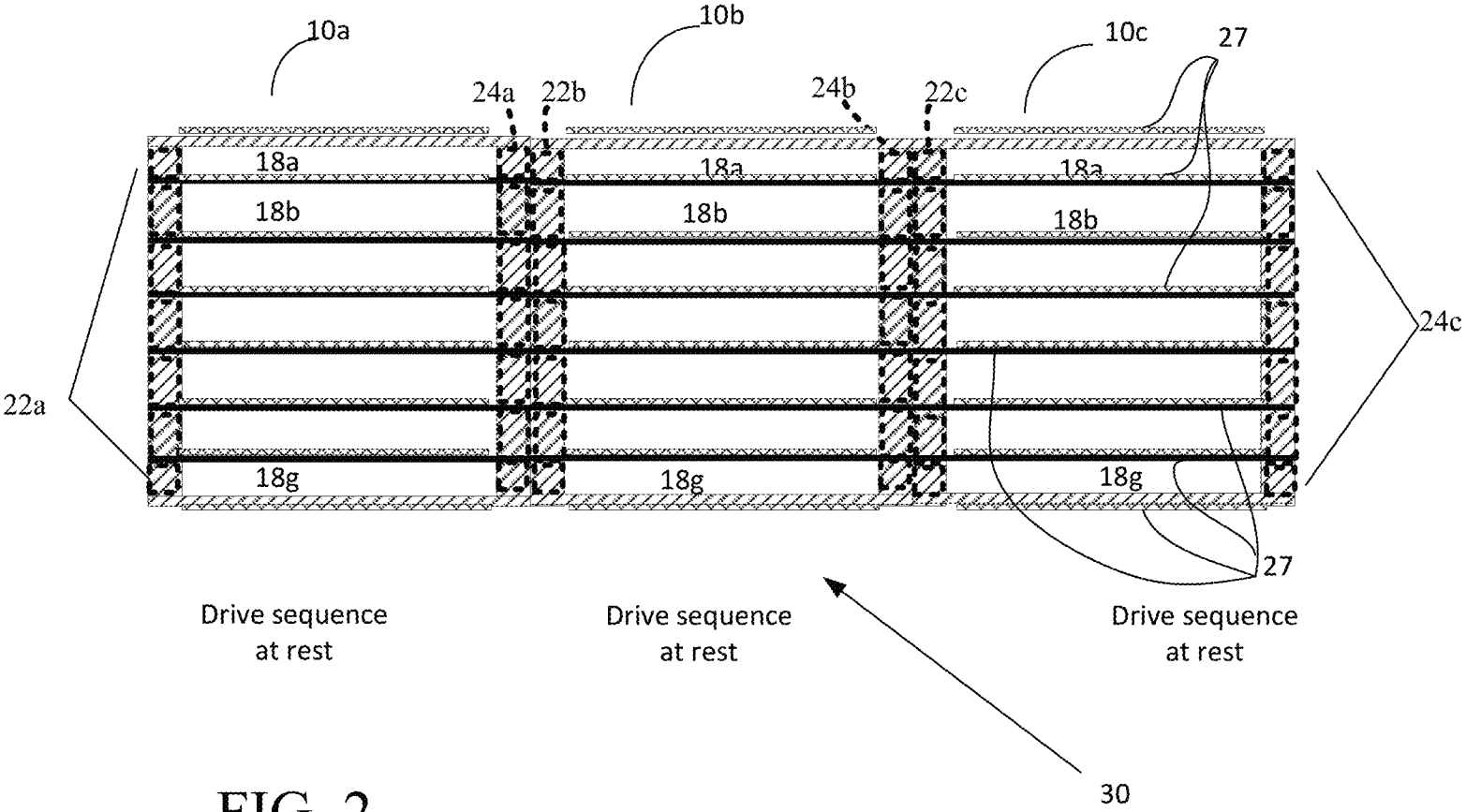
FIG. 2 is a cross-sectional view of an exemplary "valve less" micro pump comprised of plural valve less micro pump elements in a series cascaded connection arrangement.

Referring now to FIG. 2, a series configuration micro pump 30 (series configuration 30) comprising a plurality of micro pump elements 10*a*-10*c* will now be described. In the series configuration 30 three elements 10*a*-10*c* are shown. However, a given series configuration requires at least three but can comprise more than three elements. The micro pump elements 10*a*-10*c* each have a pump body (not referenced, but see FIG. 1) having a pump chamber (not referenced, but see FIG. 1) that is compartmentalized into plural compartments (not referenced, but see FIG. 1), with the plural compartments having inlet ports providing unobstructed fluid ingress into the compartments and outlet ports providing unobstructed fluid egress from the compartments. A plurality of membranes 18*a*-18*f* is disposed in the pump chamber, the membranes 18*a*-18*f* are anchored between opposing walls (not referenced, but see FIG. 1) of the pump body to provide the plural compartments. The membranes support electrodes (generally 27) that are segmented by stage (see FIG. 2A) and disposed on a major surface of each of the membranes 18*a*-18*g* (and optionally on the body, as shown). The plurality of micro pump elements 10*a*-10*c* are arranged in the series configuration with outlets of a first one of the plurality of micro pump elements 10*a*-10*c* being fluidly connected to inlets of an adjacent one of the plurality of micro pump elements 10*a*-10*c*.

The series configuration of plural micro pump elements 10*a*-10*c* (using the stack 10 of FIG. 1) provides a "valve-less" series configuration 30. A "valve-less" micro pump is defined as a micro pump comprised of three or more micro pump units that have no physical valve elements for inlets and outlets. That is, a valve-less micro pump has a configuration that effectively provides inlet and outlet isolation during pumping without individual physical valve structure elements built into the micro pump stack elements 10*a*-10*c*, e.g., at inlet and/or outlet ports and without individual physical valve structure elements between adjacent micro pump stack elements.

In the series configuration 30, each of the plural micro pump stacks 10*a*-10*c* has pairs of ports. These ports operate as either inlets or outlets or in some implementations can be i/o (inlet/outlet) ports that can change function (inlet or outlet) dynamically and pump accordingly. For discussion purposes inlet ports are referred to as 22 and outlet ports are referred to as 24. These ports 22, 24 are illustrated in phantom in FIG. 2, as the ports are not visible the view of FIG. 2.

The series configuration 30 of the micro pump elements 10*a*-10*c* shows the inlet ports 22 and the outlet ports 24 on opposing walls of the pump body. This is generally desirable, but not necessarily a requirement. Also in the series configuration 30, the micro pump stacks 10*a* and 10*c* operate as either input stages or output stages or I/O (input/output) pump stages whose functions can be changed dynamically, and the micro pump stack 10*b* being the middle stack operates as an interior isolation pump stage. The inlet ports 22 of the input stage 10*a* connect to a source of fluid and the outlet ports 24 of a last one of the micro pump elements 10*a*-10*c* are configured to connect to a sink to store pressurized fluid from the micro pump.

For discussion purposes, inlets are generally 22 and outlets are generally 24 and stage 10*a* is an input stage and 10*c* is an output stage. Thus, inlets 22*a* of the micro pump stack 10*a* are fluidly coupled to a source of fluid, such as a liquid or gas, e.g., ambient air. Outlets 24*a* of the micro pump stack 10*a* are fluidly coupled to inlets 22*b* of the micro pump stack 10*b*. Outlets 24*b* of the micro pump stack 10*b* are fluidly coupled to inlets 22*c* of the micro pump stack 10*c* and outlets 24*c* of the micro pump stack 10*c* are fluidly coupled to a sink for fluid pumped through the pump. This sink can be pressurized air from the ambient that is blown out of the micro pump or stored for instance in a tank (not shown).

Each of the micro pump stacks 10*a*-10*c* are driven using circuity discussed below and driven according to phases such as those of FIGS. 6 and 7A-7F.

Compared to a conventional pump used for similar purposes, the series configuration 30 and the micro pump elements 10*a*-10*c* use less material that is subject to less stress, and are driven using less power. The series configuration 30 has a size in the micron to millimeter scale, and can provide wide ranges of flow rates and pressure. Generally, the flow rate can be in the scale of microliters to milliliters. An approximate flow rate provided by a micro pump can be calculated as:

Flow Rate is given approximately by the total volume of the micro pump×drive frequency×(1−loss factor).

Generally, the pressure is affected by how much energy, e.g., the drive voltage, is put into the micro pump 30. In some implementations, the higher the voltage, the larger the pressure. The upper limit on voltage is defined by break down limits of the series configuration 30 and the lower limit on the voltage is defined by a membrane's ability to sufficiently flex in response to the voltage. The pressure across a series configuration 30 can be in the range of about micro psi to tenths of a psi. A selected range of flow rate and pressure can be accomplished by selection of pump materials, pump design, and pump manufacturing techniques.

One described version of the series configuration 30 is a peristaltic type pump in the displacement type category. In one implementation, pumping occurs according to six phases, as set out in FIGS. 6 and 7A-7F, discussed below.

In operation, the membrane of a conventional pump (not including the micro pump discussed in the above incorporated by reference application) typically, the pump has a single pump chamber that is used in pumping. Gas is charged and discharged once during the charging and discharging operations of a pumping cycle, respectively. The gas outflows only during half of the cycle, and the gas inflows during the other half of the cycle.

In the instant series configuration 30 each compartment is used in pumping. For example, two membranes between two fixed end walls form three compartments for pumping. The micro pump can have a higher efficiency and can consume less energy than a conventional pump performing the same amount pumping, e.g., because the individual membranes travel less distance and therefore are driven less. The efficiency and energy saving scales as the number of membranes and compartments between the two fixed end walls increases.

Generally, to perform pumping, each compartment includes a gas inlet and a gas outlet. The inlet and the outlet are valve-less, e.g., there are neither passive nor active valves that open or close in response to pressure applied to the valves, in contrast to the embodiments discussed in the above incorporated by reference application.

Figure 2A:
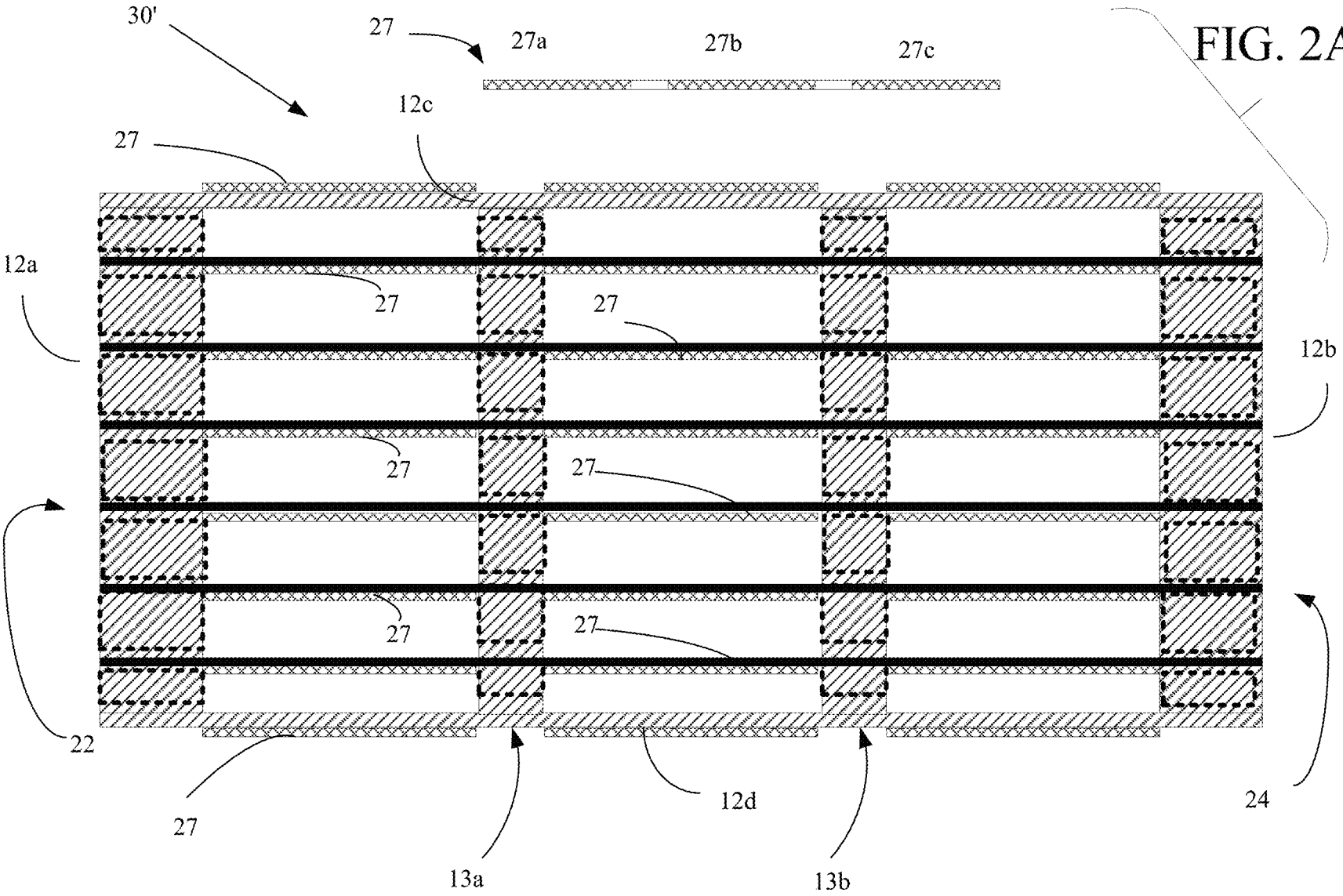
FIG. 2A is a cross-sectional view of an alternative configuration of a "valve less" micro pump.

Referring now to FIG. 2A, in one alternative embodiment of a valve less series configuration micro pump 30', the series configuration of FIG. 2 can be effectively provided by a single one of the stack elements 10 of FIG. 1 (elongated in this view). In this alternative configuration, the micro pump 30' is again "valve-less" and is produced from a single pump body 12 having two fixed walls 12*a*, 12*b* and two fixed end walls 12*c*, 12*d* opposite to each other and along a direction perpendicular to the two walls 12*a*, 12*b* together with two opposing walls (not shown in FIG. 2A, which are orthogonal to fixed walls 12*a*, 12*b* and fixed end walls 12*c*, 12*d*, all of which together form a cube-like structure) with intermediate walls 13*a*, 13*b* to provide tympanic support for membranes (not referenced).

In this alternative series configuration 30', the micro stack generally 10 effectively has three stages of a general stack 10 and has pairs of ports generally 22 and 24. The effective three stages of the general stack 10 is provided by a specific patterned electrode element 27 on the membranes and end caps (not referenced, but see FIG. 2). The ports can operate as either inlets or outlets or in some implementations can be i/o (inlet/outlet) ports that can change function dynamically. Electrodes (generally 27) are shown on the membranes (not referenced) as well as end electrodes on outer surfaces of the body. Alternatively, these electrodes could be within the body, provided that an insulating layer is used over any one of the end electrodes that could come in contact with an intermediate one of those electrodes.

Also in this series configuration 30' the specific patterned electrode element 27 comprises three, spaced and electrically isolated electrode regions 27*a*, 27*b*, 27*c*. These electrode regions are activated according to the same phases and signals discussed below. Presuming that the micro pump stack 10 has a suitable aspect ratio of width of electrode regions to height of compartments that is sufficiently low to enable the membrane to flex in three regions, similar to the arrangement of FIG. 2, the electrode regions 27*a* and 27*c* can operate the stack 10 to provide the input stages or output stages or I/O (input/output) stages, and the electrode region 27*b* can operate the stack 10 as the pump stage.

In the implementation of FIG. 2 (and FIG. 2A), the absence of mechanical valve devices requires another mechanism to maintain a differential pressure created by flow of gas in or out of a pump compartment. In this implementation of the micro pump element 10 actual mechanical valves elements are eliminated as the input/output stages are used for isolation (i.e. a valve function) in the series configuration of multiple micro pump element stages 10*a*-10*c*. Because no valves are required, the absence of such valves can reduce complications of pump fabrication and cost. In addition, unlike the embodiments discussed in the above incorporated by reference applications the mechanism discussed herein to maintain differential pressure created by flow of gas in or out of a pump compartment also obviates the need for nozzles and diffusers as mentioned in the incorporated by reference application as an alternative "valve-less" implementation that would use nozzles and diffusers. This mechanism is provided by the arrangement of FIG. 2 in which micro pump elements 10*a* and 10*c* provide ports (interchangeably input/output ports) and micro pump element 10*b* is the actual pump element.

The membranes are driven to move (flex) by electrostatic force. An electrode is attached to each of the fixed end walls and the membranes. During the charging operation of a compartment, two adjacent electrodes of the compartment have the same positive or negative voltages, causing the two electrodes and therefore, the two membranes to repel each other. During the discharging operation of a compartment, two adjacent electrodes of the compartment have opposite positive or negative voltages, causing the two electrodes and therefore, the two membranes to attract to each other. This is evident in FIGS. 1A and 1B. In this implementation of the micro pump it is desired to drive the membranes such that flexure of the membranes cause each set of membranes that constrict a compartment to seal that compartment, as denoted by reference 28 in FIG. 1C and reference 29 in FIG. 1F.

The two electrodes of a compartment form a parallel plate electrostatic actuator. The electrodes generally have small sizes and low static power consumption. A high voltage can be applied to each electrode to actuate the compartment while the actuation is performed at a relatively low current.

As described previously, each membrane of the micro pump moves in two opposite directions relative to its central, nominal position. Accordingly, compared to a compartment in a conventional pump, to expand or reduce a compartment by the same amount of volume, the membrane of this specification travels a distance less than, e.g., half of, the membrane in the conventional pump. As a result, the membrane experiences less flexing and less stress, leading to longer life and allowing for greater choice of materials. The starting drive voltage for the electrode on the membrane needs be sufficient to drive the membranes such that each travels at least half of the distance or over half the distance, which would slightly flatten the membranes where a pair of driven membranes touched. For a compartment having two membranes, since both membranes are moving, the time it takes to reach the pull-in voltage can be shorter.

Microelectromechanical systems such as micro pumps having the above described features are fabricated using roll to roll (R2R) processing. Roll-to-roll processing is becoming employed in manufacture of electronic devices using a roll of flexible plastic or metal foil as a base or substrate layer. Roll to roll processing has been used in other fields for applying coatings and printing on to a flexible material delivered from a roll and thereafter re-reeling the flexible material after processing onto an output roll. After the material has been taken up on the output roll or take-up roll the material with coating, laminates or print materials are diced or cut into finished sizes.

Below are some example criteria for choosing the materials of the different parts of the micro pump.

Pump body—The material used for the body of a pump needs to be strong or stiff enough to hold its shape to provide the pump chamber volume. In some implementations, the material is etch-able or photo-sensitive so that its features can be defined, machined and/or developed. Sometimes it is also desirable that the material interact well, e.g., adheres with the other materials in the micro pump. Furthermore, the material is electrically non-conductive. Examples of suitable materials include SU8 (negative epoxy resist), and PMMA (Polymethyl methacrylate) resist, Polyvinylidene fluoride (PVDF), Polyethylene terephthalate (PET), Polytetrafluoroethylene (PTFE) such as Teflon® The Chemours Company.

Membrane—The material for this part forms a tympanic structure (a thin tense membrane covering the pump chamber) that is used to charge and discharge the pump chamber. As such, the material is required to bend or stretch back and forth over a desired distance and has elastic characteristics. The membrane material is impermeable to fluids, including gas and liquids, is electrically non-conductive, and possesses a high breakdown voltage. Examples of suitable materials include silicon nitride and Polyvinylidene fluoride (PVDF), Polyethylene terephthalate (PET), Polytetrafluoroethylene (PTFE) such as Teflon® The Chemours Company.

Electrodes—These structures are very thin and comprised of material that is electrically conductive. Because the electrodes do not conduct much current, the material can have a high electrical sheet resistance, although the high sheet resistance feature is not necessarily desirable. The electrodes are subject to bending and stretching with the membranes, and therefore, it is desirable that the material is supple to handle the bending and stretching without fatigue and failure. In addition, the electrode material and the membrane material will need to adhere well to each other, e.g., will not delaminate from each other, under the conditions of operation. Examples of suitable materials include aluminum, gold, and platinum.

Electrical interconnects—The drive voltage is conducted to the electrode on each membrane of each compartment. Electrically conducting paths to these electrodes can be built using conductive materials, e.g., aluminum, gold, and platinum.

Figure 3:
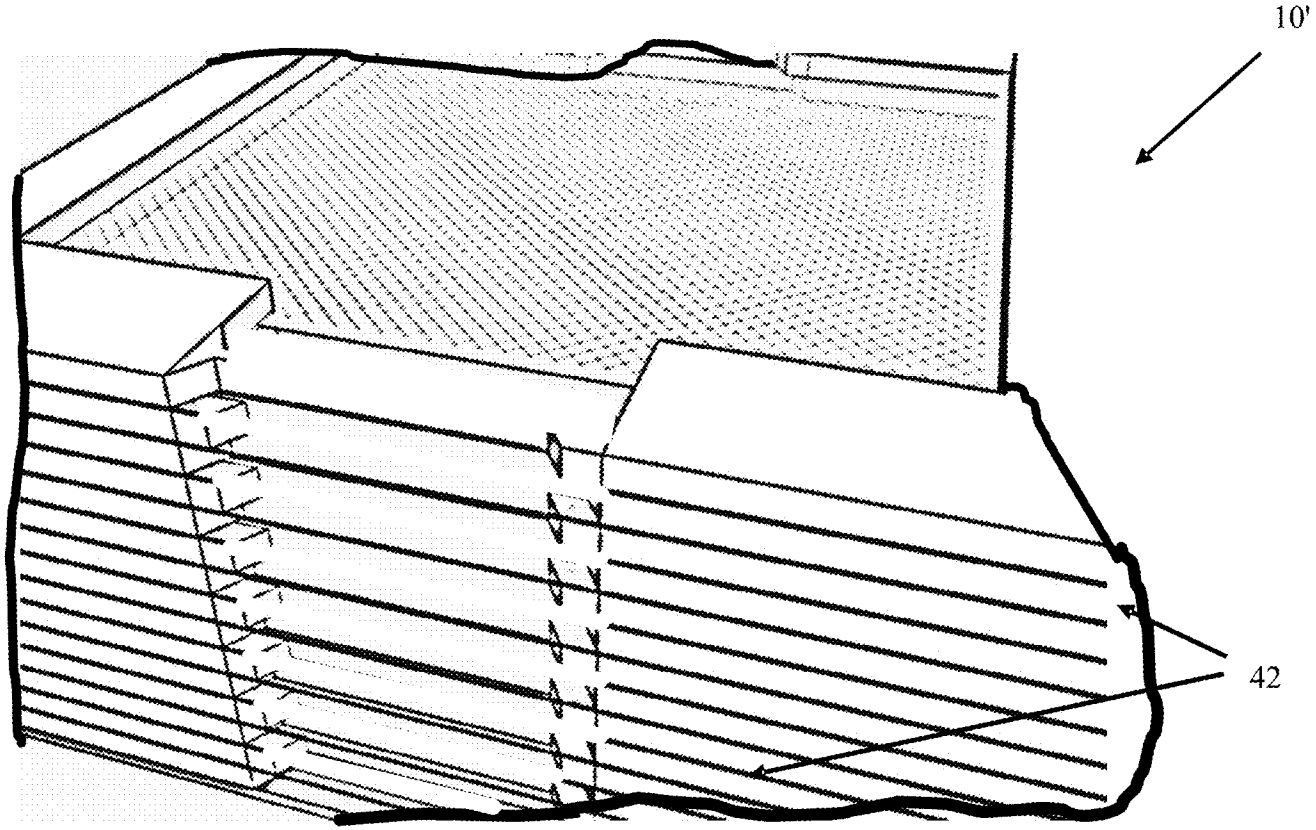
FIG. 3 is a perspective partial view of a stack of module layers that provide a micro pump element.
Figure 4:
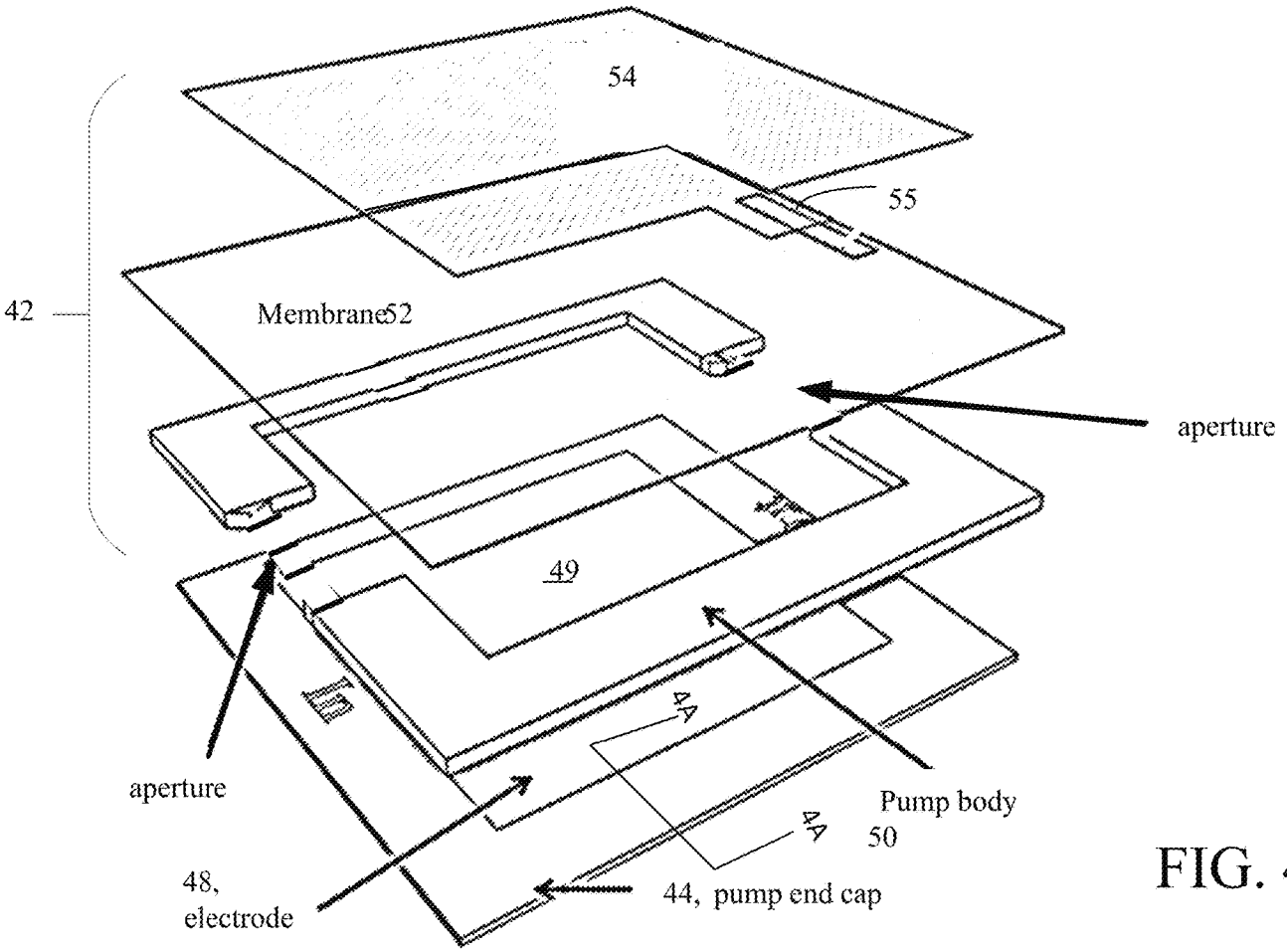
FIG. 4 is an exploded view of an intermediate module layer on an endcap module layer.
Figure 5:
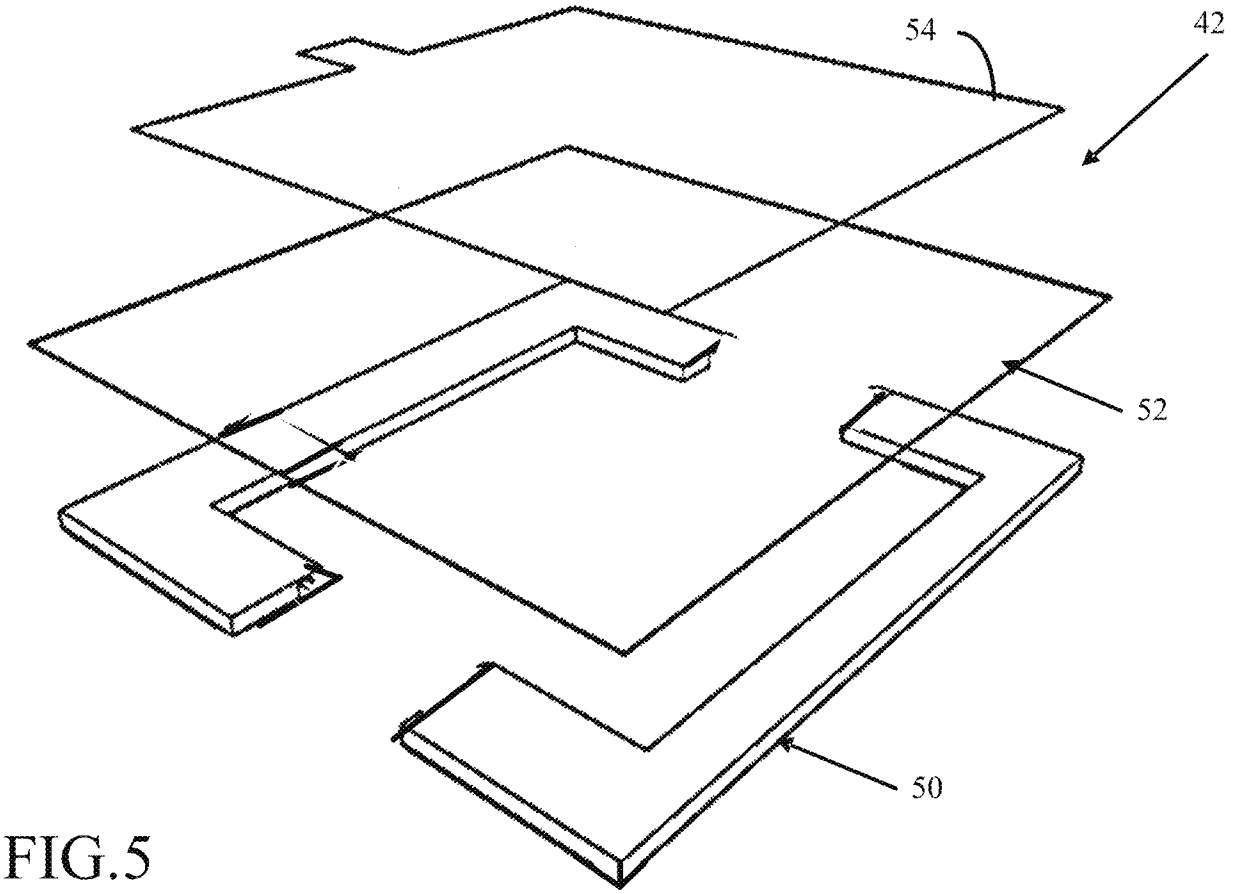
FIG. 5 is an exploded view of an intermediate module layer.

Referring now to FIGS. 3-5, a modularized "valve-less" series configuration 30 comprised of a series configuration (not shown in these figures) of micro pump elements is shown.

Referring to FIG. 3, module layers 42 can be series connected (not shown) and stacked (as shown) to provide a stack of the compartments (not referenced) for a given micro pump element to provide a modularized micro pump element 10'. The modularized micro pump element 10' is comprised of many module layers 42 (FIG. 3) that form intermediate compartments of the micro pump element 10' and plural micro pump elements 10' can be series connected as well as end compartments to provide a modularized micro pump stack (not shown in FIG. 3). The modularized micro pump element 10' is similar to that described in the above mentioned incorporated by reference published application, except that the present modularized micro pump element 10' eliminates the valve devices used with the micro pump stack in the above mentioned incorporated by reference published application. The modularized micro pump element 10' arranged in a series configuration of micro pump stack elements 10', similar to that discussed above for elements 10.

Specific details on modularized micro pump fabrication using silicon based lithographic as well as roll to roll processing are discussed below.

Figure 4A:
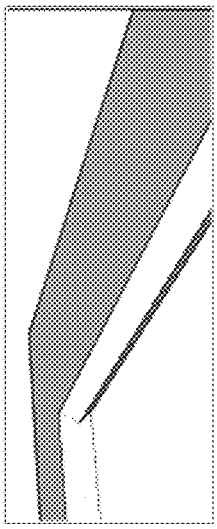
FIG. 4A is a perspective view of a portion of FIG. 4.

Referring now to FIG. 4, a pump end cap 44 forming a fixed pump wall (similar to walls 12*c*, 12*d* FIGS. 1A, 1B). An electrode 48 is attached to the pump end cap 44 for activating a compartment 49. A single module layer 42 forms a portion of a pump body 50 between the pump end cap 44 with the electrode 48, and a membrane 52 along with an electrode 54 that is attached to the membrane 52 on the opposite side of the pump body 50 (similar as the membranes in FIGS. 1A, 1B). The electrode 54 includes a lead 55 to be connected to a drive circuit external to the module layer 42. FIG. 4A shows tapered walls of an alternative for the pump body 50.

The membrane 52, the pump end cap 44, and the pump body 50 can have the same dimensions, and the electrodes 48, 54 can have smaller dimensions than the membrane 52 and the other elements. In some implementations, the membrane 52 has a dimension in a range of about a hundred microns to millimeters up to about several centimeters for thicknesses of about 5 microns. For thinner membranes, the dimensions can be smaller. The limit on the low end of the thickness range is up to where there is no permanent deformation of the membrane. For the higher end of the thickness range the limit is where membrane remains tympanic. The pump body 50 would have corresponding dimensions. The thickness of the pump body defines the nominal size of the compartment 49 (similar to compartments FIG. 1A). The electrodes 48, 54 have dimensions that substantially correspond to inner dimensions of the pump body 50. In some implementations, the electrodes 48, 54 have a surface area of about 2.25 $mm^2$ and a thickness of about 0.15 microns. Although the electrodes are shown as a pre-prepared sheet to be attached to the other elements, the electrodes can be formed directly onto those elements, e.g., by printing. The different elements of the module layers can be bonded to each other using an adhesive. In some implementations, a solvent can be used to partially melt the different elements and adhere them together or laser welding or ultrasonic welding can also be used.

Referring to FIG. 5, intermediate compartments are formed using a module layer 42. The module layer 42 includes a pump body 50, an electrode 54, and a membrane 52 formed between the electrode 54 and the pump body 50. The assembled module layers have unobstructed apertures that provide inlets and outlets and provided unobstructed paths through the pump body 50 and the compartment. A pressure differential is established with the configuration discussed above in FIG. 2. Multiple, e.g., two, three, or any desired number of, module layers of FIG. 5 are stacked on top of each other to form multiple intermediate compartments in a pump chamber. In the stack 40, each membrane is separated by a pump body and each pump body is separated by a membrane. To form a complete pump (such as a micro pump element 10), a module layer of FIG. 4 (end cap module) is placed on each of the top and bottom ends of the stack so that the pump end caps of the module layer form two fixed end walls of the pump chamber.

A charging operation is established when pressure external to a module layer is larger than pressure inside the module layer, and thus a fluid flows from outside the module layer into the compartment. When the internal pressure is higher than the external pressure, a discharge operation is established and fluid flows from the compartment away to the outside of the module layer. Discharge occurs by displacement meaning that the pump can discharge fluid at ambient pressure. During the discharge operation, the fluid in the compartment does not flow out from the inlet due to the configuration, as driven as discussed below. Effectively, during the charging operation, the outlet is closed so that the fluid does not flow out of the compartment, and during the discharging operation, the outlet is open and the fluid flows out of the compartment.

Figure 6A:
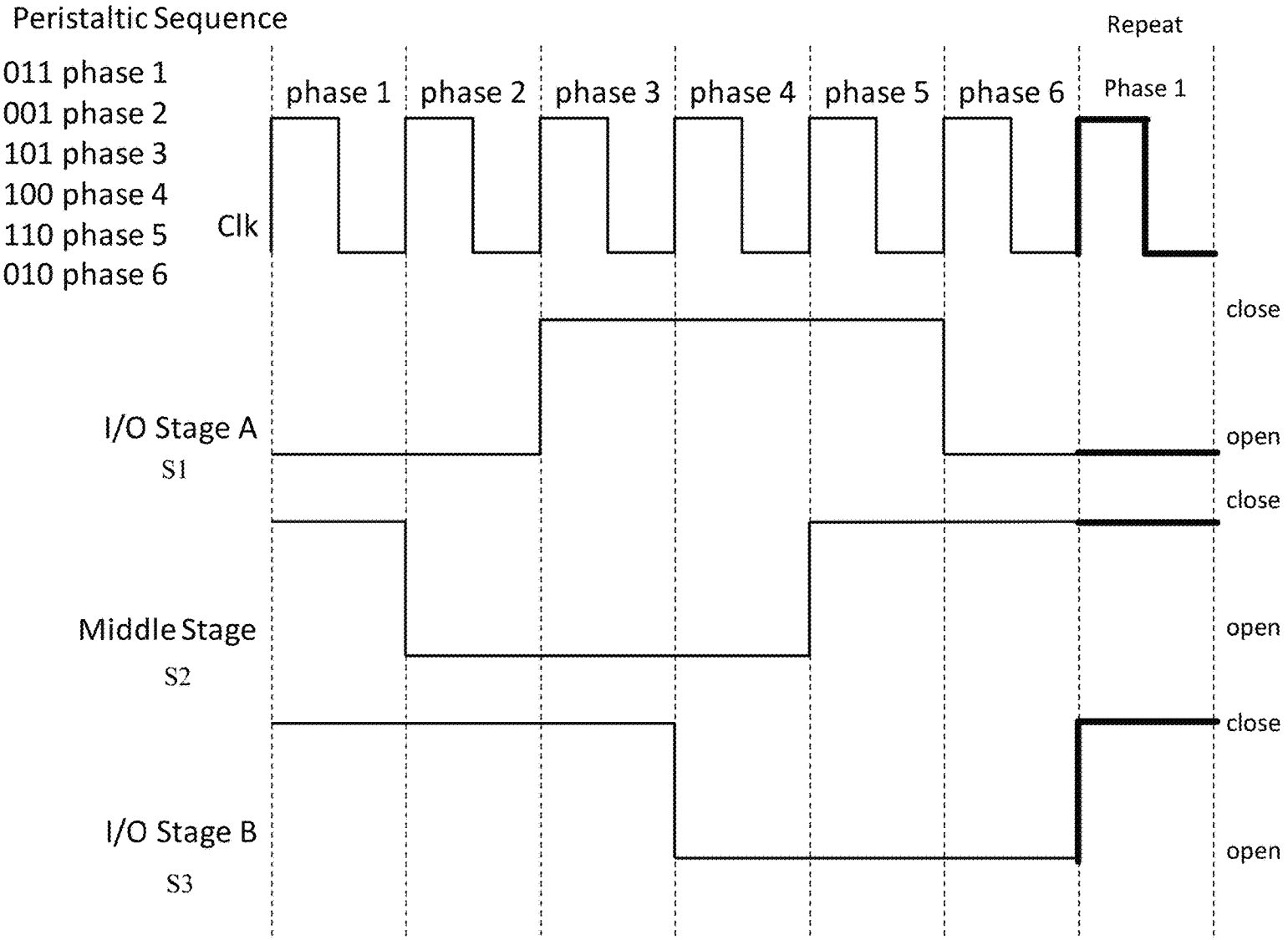
FIGS. 6A and 6B are plots of waveforms of signals applied to electrodes showing phases for a peristaltic pumping sequence using the valve less micro pump of FIG. 2.
Figure 6B:
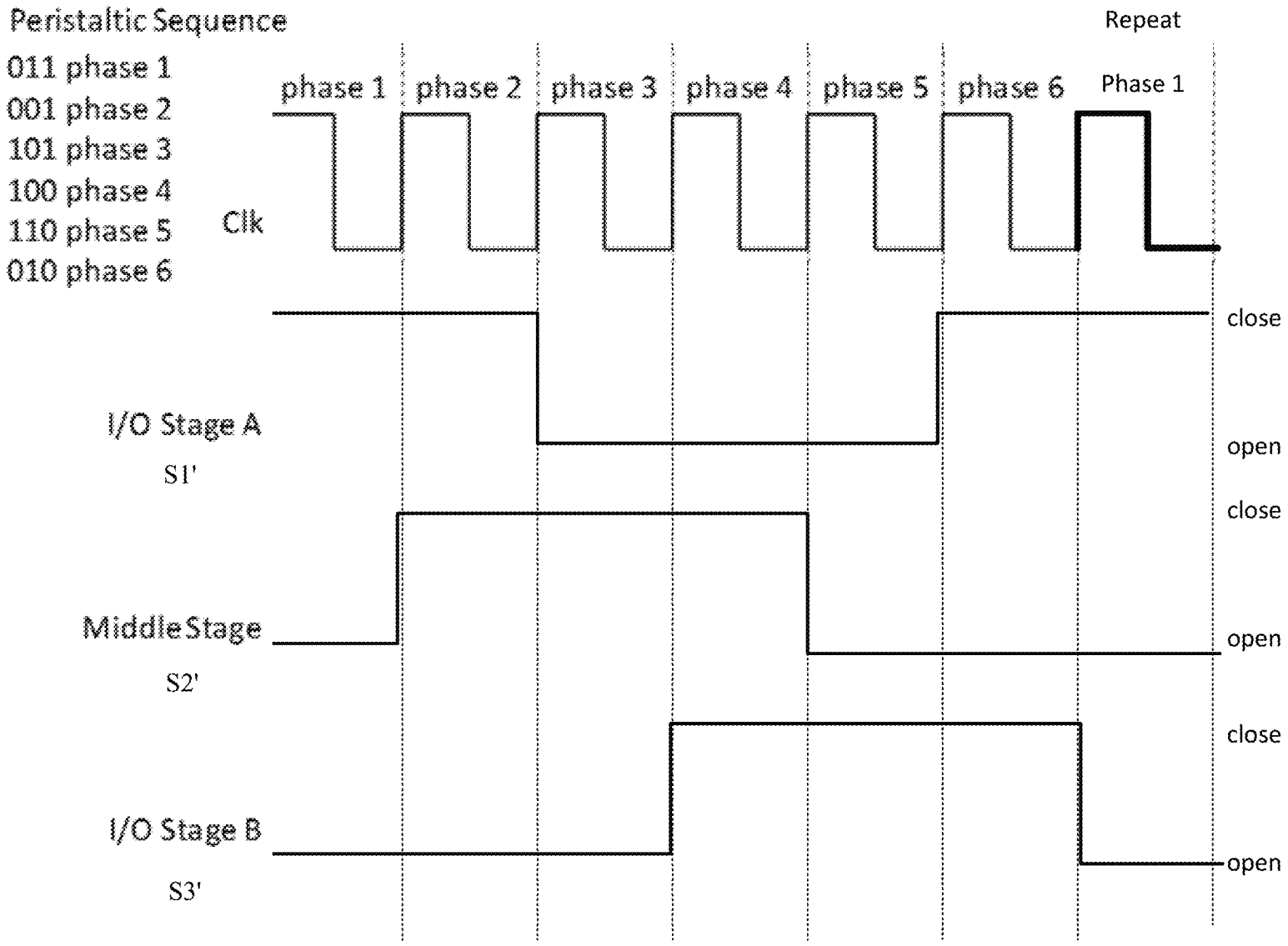

Referring now to FIGS. 6A, 6B, timing waveforms for a peristaltic sequence are shown. As shown there are six phases to form a sequence that repeats. FIG. 6A shows a true phase and FIG. 6B shows the complement of the true phase, which together provide for six signals S1, S1' S2, S2' and S3, S3' to drive respective groups of membranes, as more fully explained in FIGS. 7A-7F. The timing waveforms represent when a stage is open (logic 0) and when a stage is closed (logic 1). A clock signal is also shown.

Referring now to FIGS. 7A-7F, states of each of the compartments in each of the stages in the series configuration 30 are shown. I/O ports while present, are not shown in these figures. In each figure the peristaltic sequence is shown and is labeled according to a phase, and a table is shown with the phases each of the channels 1-7 (i.e., paths between an input and an output of each module layer) is in. Thus for FIG. 7A, Channel 1 has stage 10*a* open (logic 0), stage 10*b* closed (logic 1) and stage 10*c* closed (logic 1), which corresponds to phase 1, whereas, Channel 2 has stage 10*a* closed (logic 1), stage 10*b* open (logic 0) and stage 10*c* open (logic 0), which corresponds to phase 4. The operation of opening and closing channels is provided by applying drive signals to each of the electrodes, as shown.

Figure 7A:
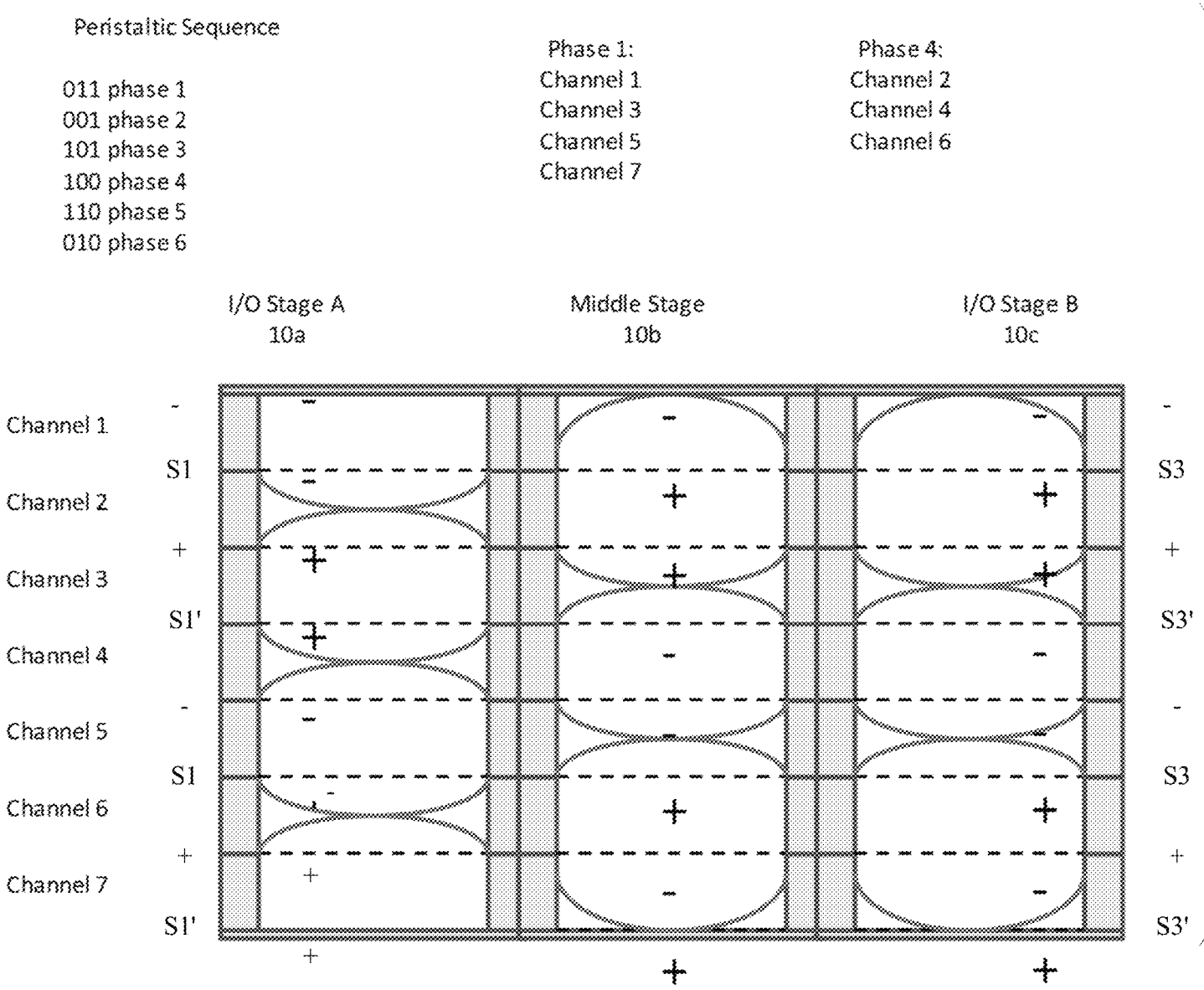
FIGS. 7A to 7F are diagrams depicting series configured "valve less" micro pump of FIG. 2 operation according to the phases for the peristaltic pumping sequence.
Figure 7B:
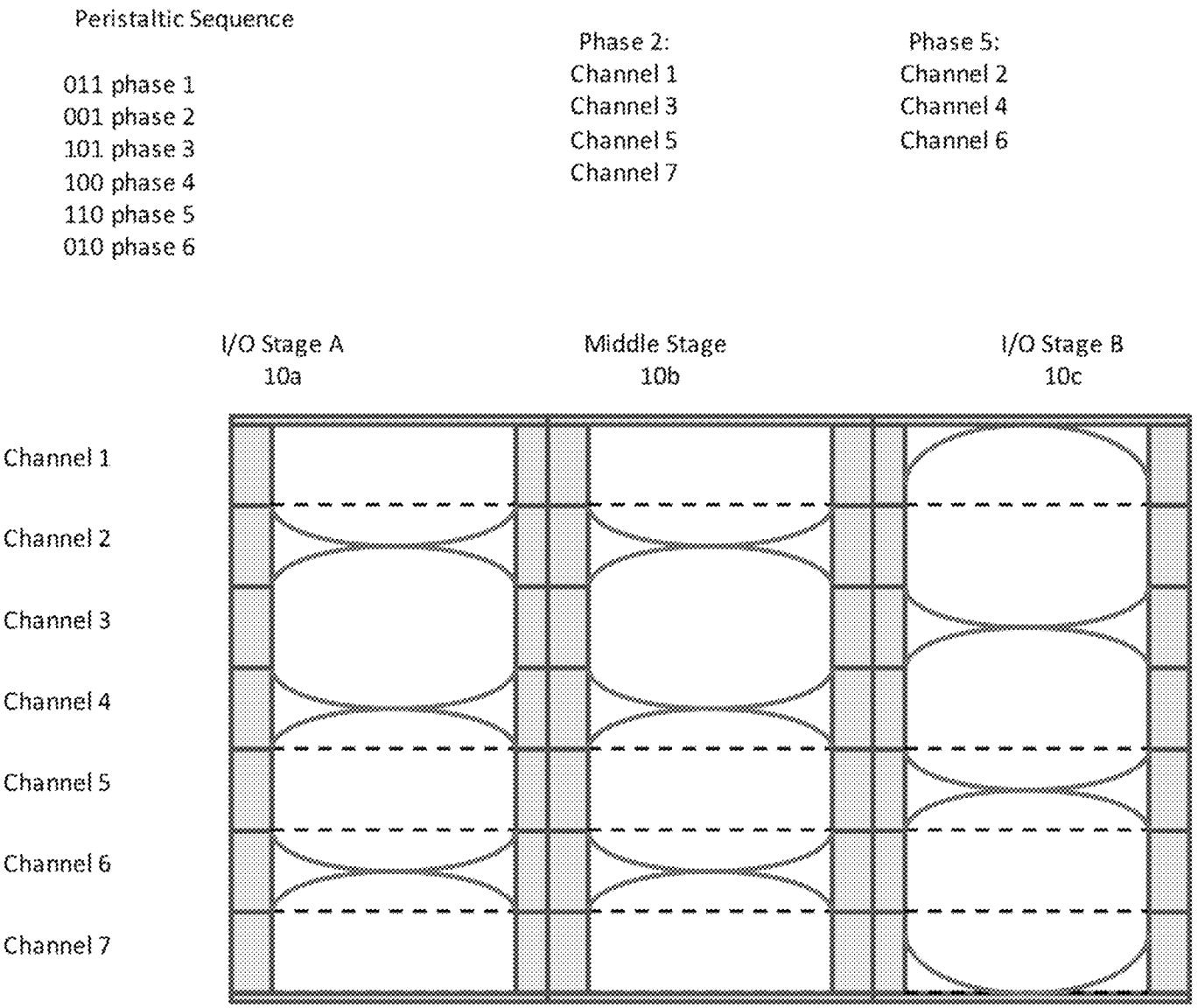
Figure 7C:
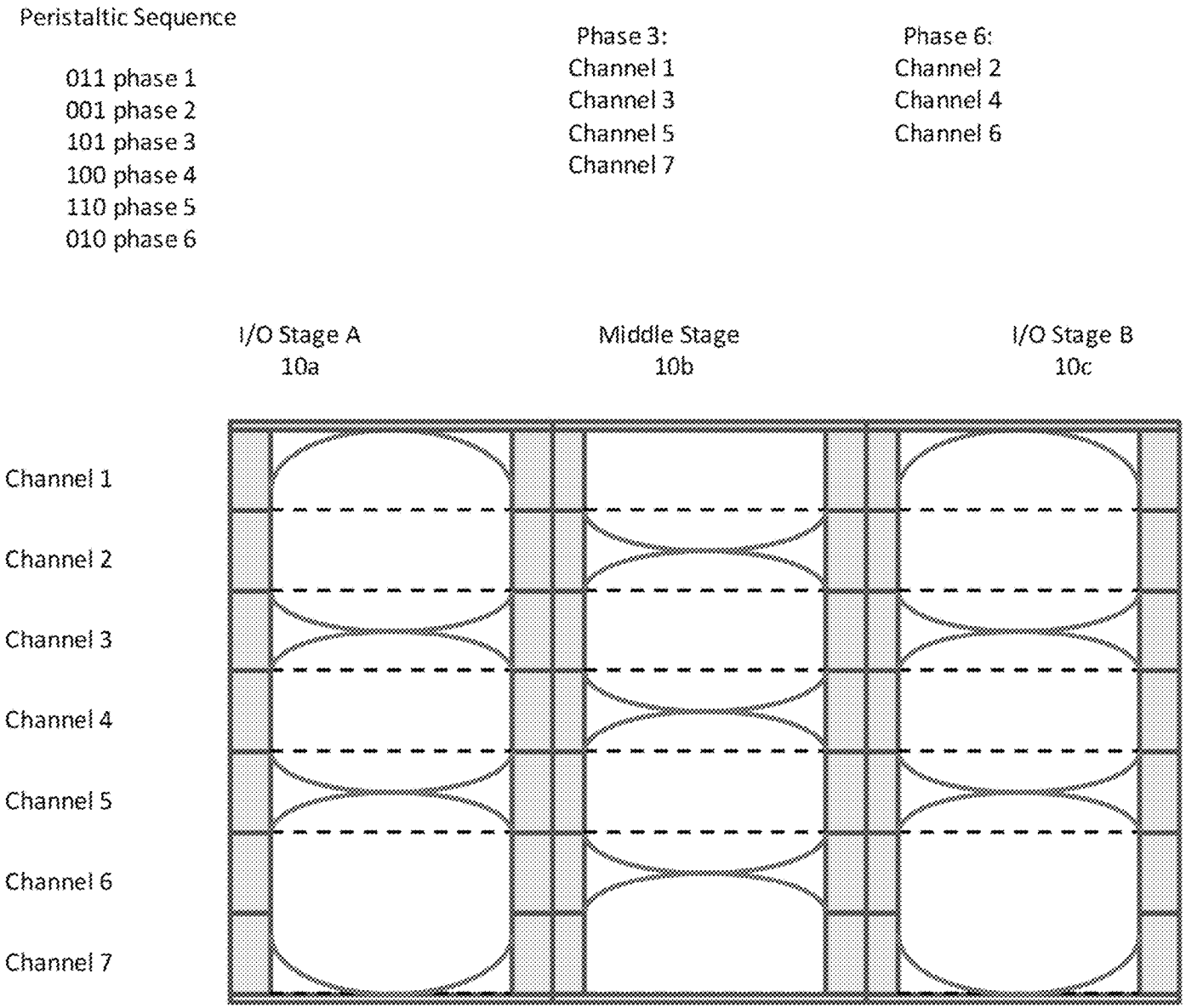
Figure 7D:
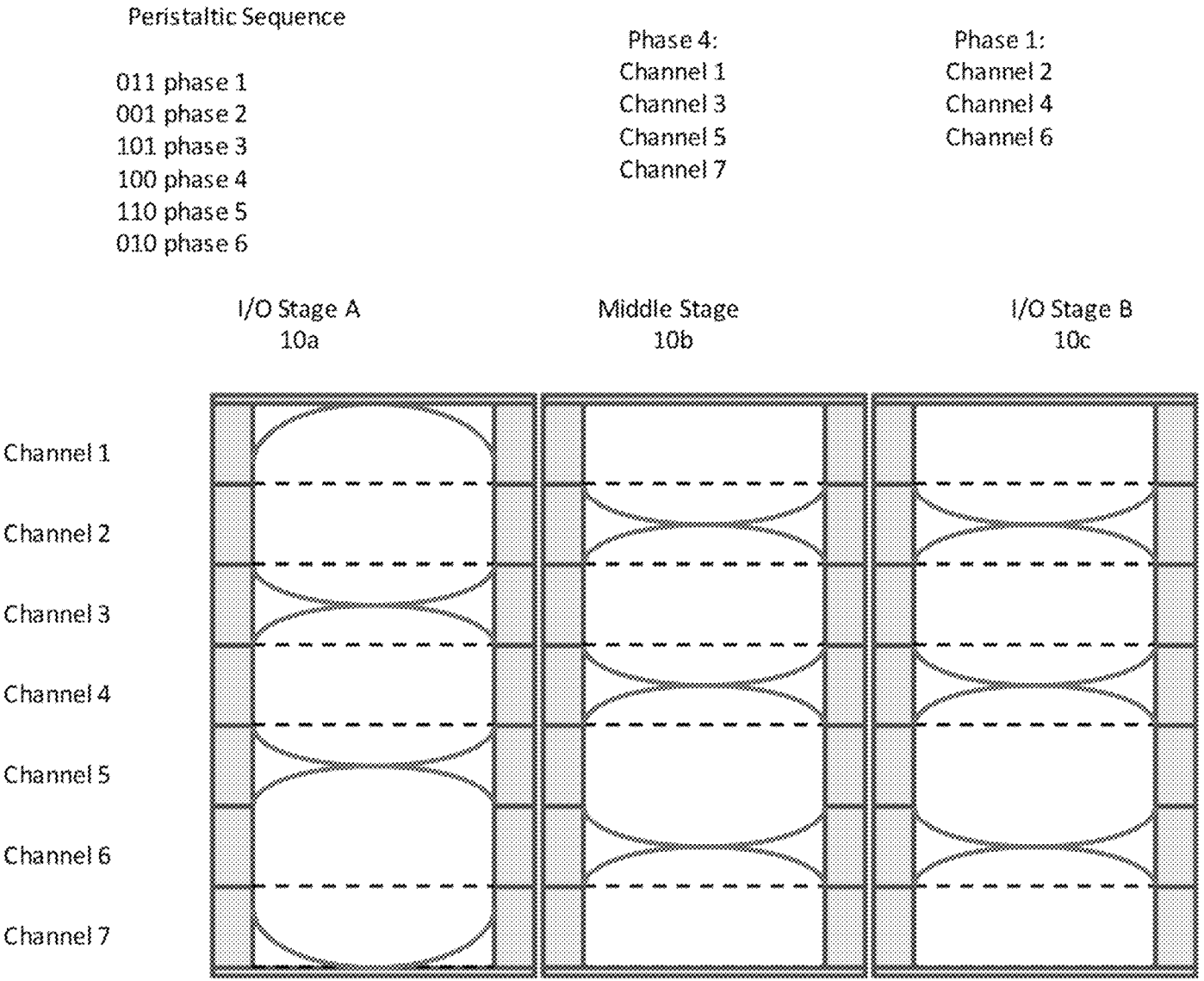
Figure 7E:
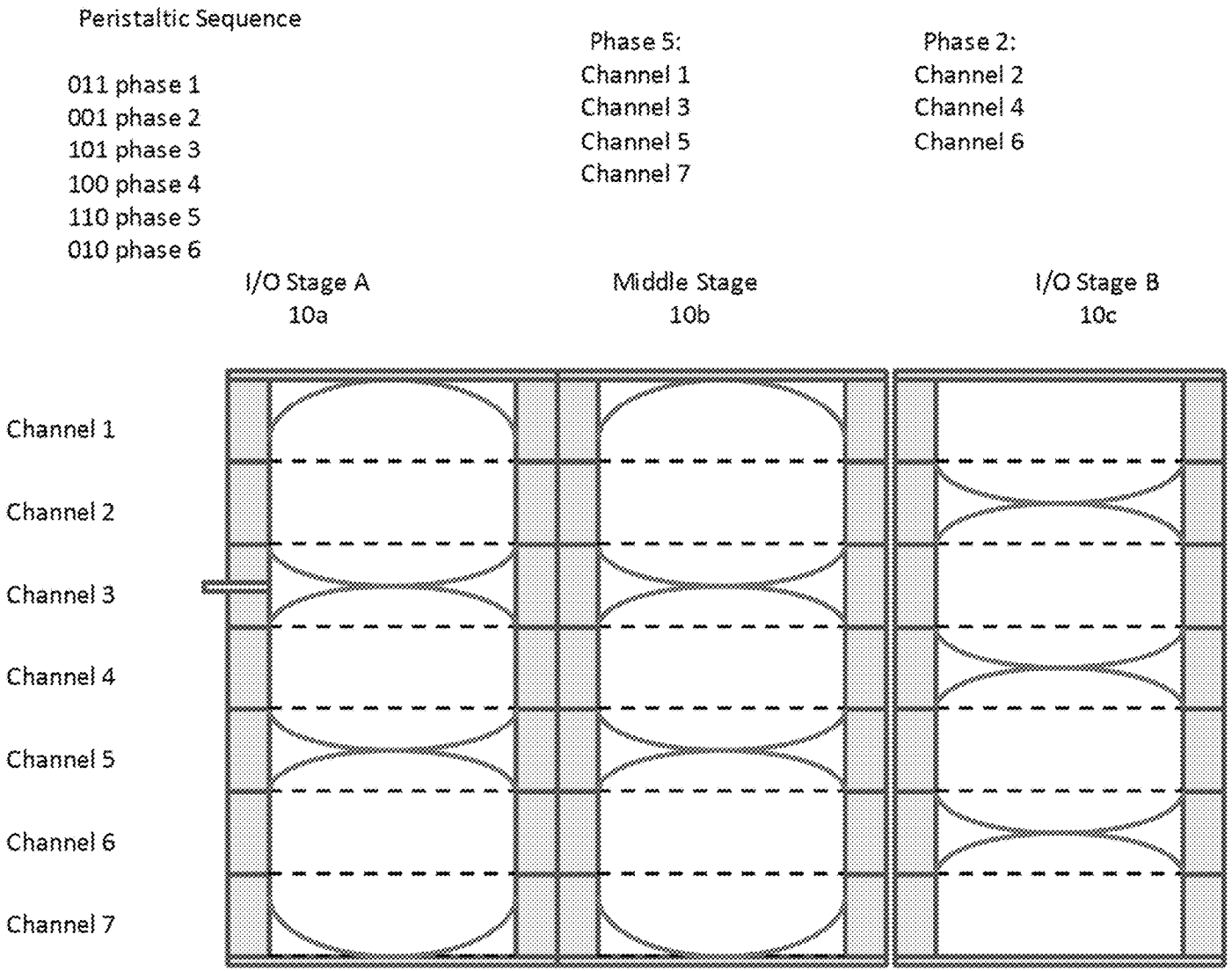
Figure 7F:
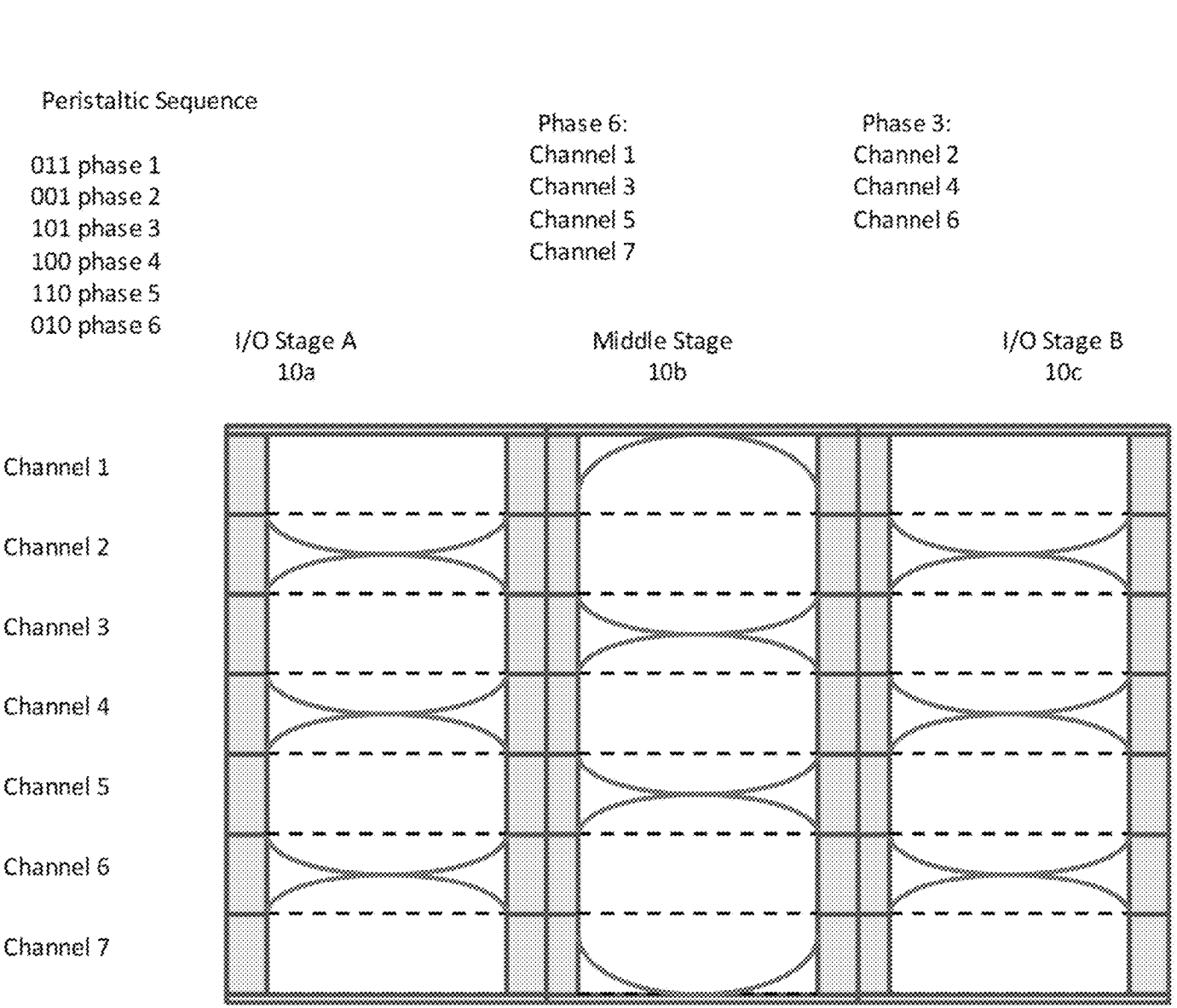

The micro pump stacks 10*a*-10*c* are driven according to the phases denoted in the peristaltic sequence. Other sequences may be possible. In the peristaltic sequence, as shown in FIG. 7A, for Channel 1 stack 10*a* is in an intake phase, i.e., has its inlet unobstructed (as are Channels 3, 5 and 7) but its outlet is obstructed by the adjacent stack 10*b*. This allows Channel 1 in stack 10*a* to fill with fluid by having the first stack driven by the appropriate phase of the waveforms of e.g., FIG. 6, but having the adjacent stack being driven by a waveform of an opposite polarity to those waveforms that are driving the first stack. The opposite occurs for Channels 2, 4 and 6, as shown.

The first stack 10*a* inputs air into channels 1, 3, 5, and 7 (compartments 18*a*, 18*c*, 18*e* and 18*g* FIG. 1) during an intake phase of those channels in stack 10*a*. However, the second stack 10*b* and third stack 10*c* each have its channels 1, 3, 5, and 7 (compartments 18*a*, 18*c*, 18*e* and 18*g* FIG. 1) obstructed by the membranes, during the intake phase of stack 10*a*, thus effectively providing functionality of opening input valves at inputs of the first stack and closing output valves at outlets of the first stack 10*a* for channels 1, 3, 5 and 7.

Simultaneously, the first stack 10*a* closes off channels 2, 4, and 6 (compartments 18*b*, 18*d*, and 18*f* FIG. 1) during an output phase of those channels in stack 10*a*. However, the second stack 10*b* and third stack 10*c* each have its channels 2, 4, and 6 (compartments 18*b*, 18*d*, and 18*f* FIG. 1) unobstructed by the membranes, during the output phase of those channels of stack 10*b* and stack 10*c*, thus effectively providing functionality of closing input valves at inlets of the first stack 10*a* and opening output valves at outlets of the second and third stacks 10*a* for channels 2, 4, and 6.

Meanwhile, the second stack 10*b* has its compartments 18*b*, 18*d* and 18*f* obstructed by the membranes in compartments 18*a*, 18*c*, 18*e* and 18*g* of the first stack 10*a* and by the membranes in compartments 18*a*, 18*c*, 18*e* and 18*g* of the third stack 10*c*, thus effectively providing functionality of valves at inlets and outlets of the second stack 10*b*. Any air that was in the compartments 18*a*, 18*c*, 18*e* and 18*g* of the first stack and the third stack is pumped into compartments 18*b*, 18*d* and 18*f* of the second stack and in this example the output of the micro pump 30.

For example, referring back to FIG. 7A, the voltage on the electrode on the fixed wall is negative and the voltage applied to the electrode on the first membrane adjacent to the wall is also negative to repel that first membrane away from the wall. However, the voltage on the second membrane is positive, which would tend to have second membrane attract to the first membrane, etc. Thus, voltages of same signs are applied to the electrodes on opposing walls of these other compartments. Thus, voltages of opposite signs cause the two opposing walls of the compartments to attract each other and the voltages of the same signs cause the two opposing walls of the compartments to repel each other. The polarities for each of the signals applied to the electrodes will thus be according to the drive sequence. The membranes move towards a direction of the attraction force or a direction of the repelling force. As a result, each sequence of a pumping cycle (six sequences for the peristaltic sequence), some of the compartments discharge and other compartments simultaneously charge, and in other sequences of the pumping cycle, others of the compartments discharge and simultaneously charge as per FIGS. 7A-7F.

The material of the membranes and the voltages to be applied to the membranes and the end walls are chosen such that when activated, each membrane expands at least half the distance d between the nominal positions of adjacent membranes and in some implementations the membrane can be driven to expand an additional amount more than half of the distance (thus distorting the membranes somewhat). In the end compartments where the distance between the nominal position of the membrane and the fixed wall is d/2, the activated membrane reduces the volume of the compartment to close to zero (in a discharging operation) and expands the volume of the compartment to close to $2*V_e$. For the intermediate compartments, by moving each membrane by d/2, a volume of a compartment is expanded to close to $2*V_i$ in a charging operation and reduced to close to zero in a discharging operation. The micro pump can operate at a high efficiency.

The period of the pumping cycle can be determined based on the frequency of the drive voltage signals. In some implementations, the frequency of the drive voltage signal is about Hz to about KHz, e.g., about 2 KHz. A flow rate or pressure generated by the pumping of the micro pump can be affected by the volume of each compartment, the amount of displacement the membranes make upon activation, and the pumping cycle period. Various flow rates, including high flow rates, e.g., in the order of ml/s, and pressure, including high pressure, e.g., in the order of tenths of one psi, can be achieved by selecting the different parameters, e.g., the magnitude of the drive voltage. As an example, a micro pump can include a total of 15 module layers.

The sets of electrical signals are applied to the micro pump elements such that a first set of the electrical signals cause in a first one of the plurality of micro pump elements, a first one of the plural compartments to compress and at least one adjacent one of the plural compartments to expand substantially simultaneously and a second set of the electrical signals applied simultaneously with the first set to cause in a second, adjacent one of the plurality of micro pump elements a first one of the plural compartments to expand and at least one adjacent one of the plural compartments to compress substantially simultaneously. Other sets of electrical signals cause corresponding actions, especially according to a peristaltic sequence having six phases, which for a micro pump where the plurality of micro pump elements consist essentially of an input element, a pump element and an output element, according to:

011
001
101
100
110
010 with 0 corresponding to a first one of open or close of a compartment, 1 corresponding to a second, different one of open or close of a compartment and each of the phases having the values for respectively the input element, the pump element and the output element.

Drive Circuitry

A drive circuit for applying voltages to the electrodes takes a low DC voltage supply and converts it to a pulse level waveform. The frequency and shape of the waveform can be controlled by a voltage controlled oscillator. The drive voltage can be stepped up by a multiplier circuit to the required level. To operate compartments of the pump in their discharging state, voltages of opposite polarities are applied to the electrodes on opposing walls and membranes of these compartments to make the membranes flex according to the sequence. These signals applied to the electrodes are thus the true and complement versions of the waveforms of FIG. 6.

Figure 8:
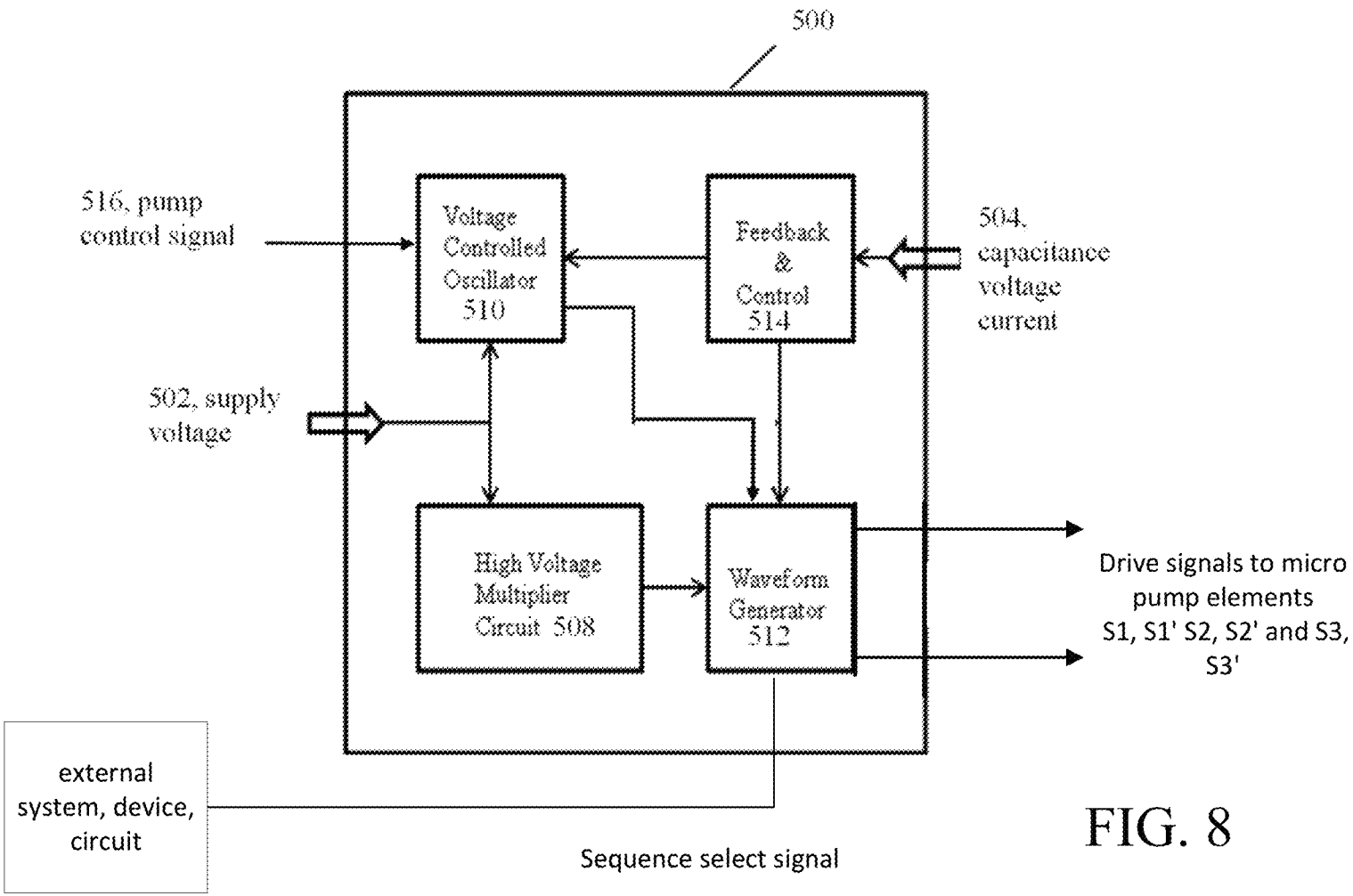
FIG. 8 is a functional block diagram of exemplary circuitry for the micro pump.

Referring now to FIG. 8, an example of drive circuitry 500 for applying voltages is shown. The drive circuitry 500 receives a supply voltage 502, a capacitance voltage current 504 signal, and pump control 516, and outputs drive voltages 506 to electrodes of the micro pump 30. In some implementations, the supply voltage 502 is provided from a system in which the micro pump 100 is used. The supply voltage can also be provided by an isolation circuit (not shown). Power can be provided by a battery or other sources. The drive circuitry 500 includes a high voltage multiplier circuit 508, a voltage controlled oscillator ("VCO") 510, a waveform generator circuit 512, and a feedback and control circuit 514. The high voltage multiplier circuit 508 multiplies the supply voltage 502 up to a desired high voltage value, e.g., about 100V to 700V, nominally, 500 V. Other voltages depending on material characteristics, such as dielectric constants, thicknesses, mechanical modulus characteristics, electrode spacing, etc. can be used. In some implementations, the high voltage multiplier circuit 508 includes a voltage step-up circuit (not shown). The voltage controlled oscillator 510 produces a drive frequency for the micro pumps. The oscillator 510 is voltage controlled and the frequency can be changed by an external pump control signal 516 so that the pump 100 pushes more or less fluid based on flow rate requirements. The waveform generator circuit 512 generates the drive voltages for the electrodes. As described previously, some of the drive voltages are AC voltages with a specific phase relationship to each other. The waveform generator circuit 512 controls these phases as well as the shape of the waveforms. The feedback and control circuit 514 receives signals that provide measures of capacitance, voltage and or current in the micro pump and the circuit 514 can produce a feedback signal to provide additional control of the waveform generator 512 of the circuit 500 to help adjust the drive voltages for desired performance.

Integration of the Systems in Devices

The micro pump systems described above can be integrated in different products or devices to perform different functions. For example, the micro pump systems can replace a fan or a blower in a device, e.g., a computer or a refrigerator, as air movers to move air. Compared to the conventional fans or blowers, the micro pumps may be able to perform better at a lower cost with a higher reliability. In some implementations, these air movers are directly built into a host at a fundamental level in a massively parallel configuration. In general, the series configuration 30 can be used in many applications that call for peristaltic pumps.

In some implementations, the micro pump systems receive power from a host product into which the systems are integrated. The power can be received in the form of a single, relatively low voltage, e.g., as low as 5V or lower, to a drive circuitry of the micro pump systems, e.g., the drive circuitry 500 of FIG. 11.

System Configuration

The module layer stack can be viewed as module layers connected in parallel. The volume of each individual module layer, $V_i$ or $V_e$, is small. In some implementations, even the total volume of all layers in the stack is relatively small. In some implementations, multiple stacks or micro pumps can be connected in parallel to increase the total volume flow rate.

Similarly, the pressure capability of an individual micro pump is relatively low. Even though there are multiple module layers in a stack, the layers do not increase the total pressure of the stack because they are connected in parallel. However, the pressure of the stack can be increased when multiple stacks or micro pumps are connected in series.

In some implementations, the micro pumps 30 are connected in series are driven at different speeds to compensate for different mass flow rates. For example, built-in plenums or plumbing in a tree type configuration can also be used to compensate for different mass flow rates. Effectively, the serially connected stacks in each row can provide a total pressure substantially equal the sum of the individual stack pressures.

Alternative Operation Modes

An alternative mode of operation of the series connected set of valve-less micro pump elements is dynamic mode change. With these valve-less micro pump elements connected in a series configuration this need not be a fixed correspondence between inlet and outlet functions. Thus by driving the micro pump elements according to a first peristaltic sequence in a first mode of operation, a first one of the plurality of micro pump elements having a port that is an inlet port of the series configuration, and a last one of the plurality of micro pump elements having a port that is an outlet port of the series configuration. However, by driving the micro pump elements according to a second, different peristaltic sequence for a second, different mode of operation, with the port of the first one of the plurality of micro pump being the outlet port of the series configuration, and the port of the last one of the plurality of micro pump elements being the inlet port of the series configuration the second mode dynamically changes the ports that function as the input port and output port of the series configuration. Properly therefore these are referred to as I/O ports.

In this mode the first and second peristaltic sequences each have six phases, with the first peristaltic sequence given as:

011
001
101
100
110
010 and the second, different peristaltic sequence given as:

100
110
010
011
001
101 with "0" being a logic value corresponding to a first one of open or close of a compartment, "1" being a logic value corresponding to a second, different one of open or close of a compartment and each of the phases having the values for respectively the input element, the pump element and the output element.

Alternative Construction/Operation Modes

A novel construction of a series connected set of valve-less micro pump elements is can have built in redundancy that together with dynamic mode changes can provide various novel operation modes. With these valve-less micro pump elements connected in a series configuration the series connection can have a variable number of or arrangement of units devoted to inlet, pump, and outlet functions. Such a micro pump would have several (more than three), e.g., four, ten or 15, or more or many more micro pump elements each having a pump chamber compartmentalized into plural compartments, with compartments of the plural compartments having inlet ports providing unobstructed fluid ingress into the compartments and outlet ports providing unobstructed fluid egress from the compartments, together with membranes disposed anchored between opposing walls of the pump body and forming the plural compartments and electrodes disposed on major surfaces of the membranes.

Drive circuity provide signals to the plurality of electrodes according to a sequence, with a first portion of the plurality of micro pump elements driven by a first subset of signals in the sequence, a second portion of the plurality of micro pump elements driven by a second subset of signals in the sequence, and with a third portion of the plurality of micro pump elements driven by a third subset of signals in the sequence. The first portion of micro pump elements provides an input element, the second portion of the plurality of micro pump elements provides a pump element and the third portion of the plurality of micro pump elements provides an output element of the series configuration. These micro pump elements are dynamically configurable, meaning that the functions of the first and third portions are dynamically configurable by adjusting the sequence. The first, second and third subsets of signals are applied as a peristaltic sequence, with each of the first, second and third subsets of the peristaltic sequence being 011
001
101
100
110
010 with "0" being a logic value corresponding to a first one of open or close of a compartment, "1" being a logic value corresponding to a second, different one of open or close of a compartment and each of the phases having the values for respectively the input element, the pump element and the output element. Typically, the drive circuity would be responsive to a control signal to change the sequence. The control signal would typically be generated external to the micro pump and the drive circuity by an external system, device and/or circuit (FIG. 8).

Exemplary Applications

Exemplary applications of the series configuration 30 can be those as discussed in the above mentioned incorporated by reference publications, without substantial variation, presuming use of the series interconnected micro pump modules in a valve-less configuration. Similarly, construction of the series interconnected micro pump modules in a "valve-less" configuration is without substantial variation to the techniques described in the above incorporated by reference publications but for modifications of masks or elimination processing that was needed for formation of inlet and outlet valves on the micro pump modules and subsequent fabrication of the micro pumps using the series configuration.

Fabrication techniques can include the Roll to Roll processing as described below or as described in the above incorporated by reference publications.

Roll to Roll Processing for Producing Micro Pumps

A roll to roll processing line comprises several stations that can be or include enclosed chambers at which deposition, patterning, and other processing occurs. Processing viewed at a high level thus can be additive (adding material exactly where wanted) or subtractive (removing material in places where not wanted) or combinations of both. Deposition processing includes evaporation, sputtering, and/or chemical vapor deposition (CVD), as needed, as well as printing. The patterning processing can include depending on requirements techniques such as scanning laser and electron beam pattern generation, machining, optical lithography, gravure and flexographic (offset) printing depending on resolution of features being patterned. Ink jet printing and screen printing can be used to put down functional materials such as conductors. Other techniques such as imprinting and embossing can be used.

The original raw material roll is of a web of flexible material. In roll to roll processing the web of flexible material can be any such material and is typically glass or a plastic or a stainless steel. While any of these materials (or others) could be used, plastic has the advantage of lower cost considerations over glass and stainless steel and is a biocompatible material for production of the micro pump when used in a CPAP type (continuous positive airway pressure) breathing device (see incorporated by reference applications). In other applications. of the micro-pump, e.g., as a cooling component for electronic components other materials such as stainless steel or other materials that can withstand encountered temperatures would be used, such as Teflon and other plastics that can withstand encountered temperatures.

The membrane material is required to bend or stretch back and forth over a desired distance and thus should have elastic characteristics. The membrane material is impermeable to fluids, including gas and liquids, is electrically non-conductive, and possesses a high breakdown voltage. Examples of suitable materials include silicon nitride and Teflon. The material of the electrodes is electrically conductive. The electrodes do not conduct significant current. The material can have a high electrical resistance, although the high resistance feature is not necessarily desirable. The electrodes are subject to bending and stretching with the membranes, and therefore, it is desirable that the material is supple to handle the bending and stretching without fatigue and failure. In addition, the electrode material and the membrane material adhere well, e.g., do not delaminate from each other, under the conditions of operation. Examples of suitable materials include, e.g., aluminum, gold, silver, and platinum layers (or conductive inks such as silver inks and the like).

Figure 9A:
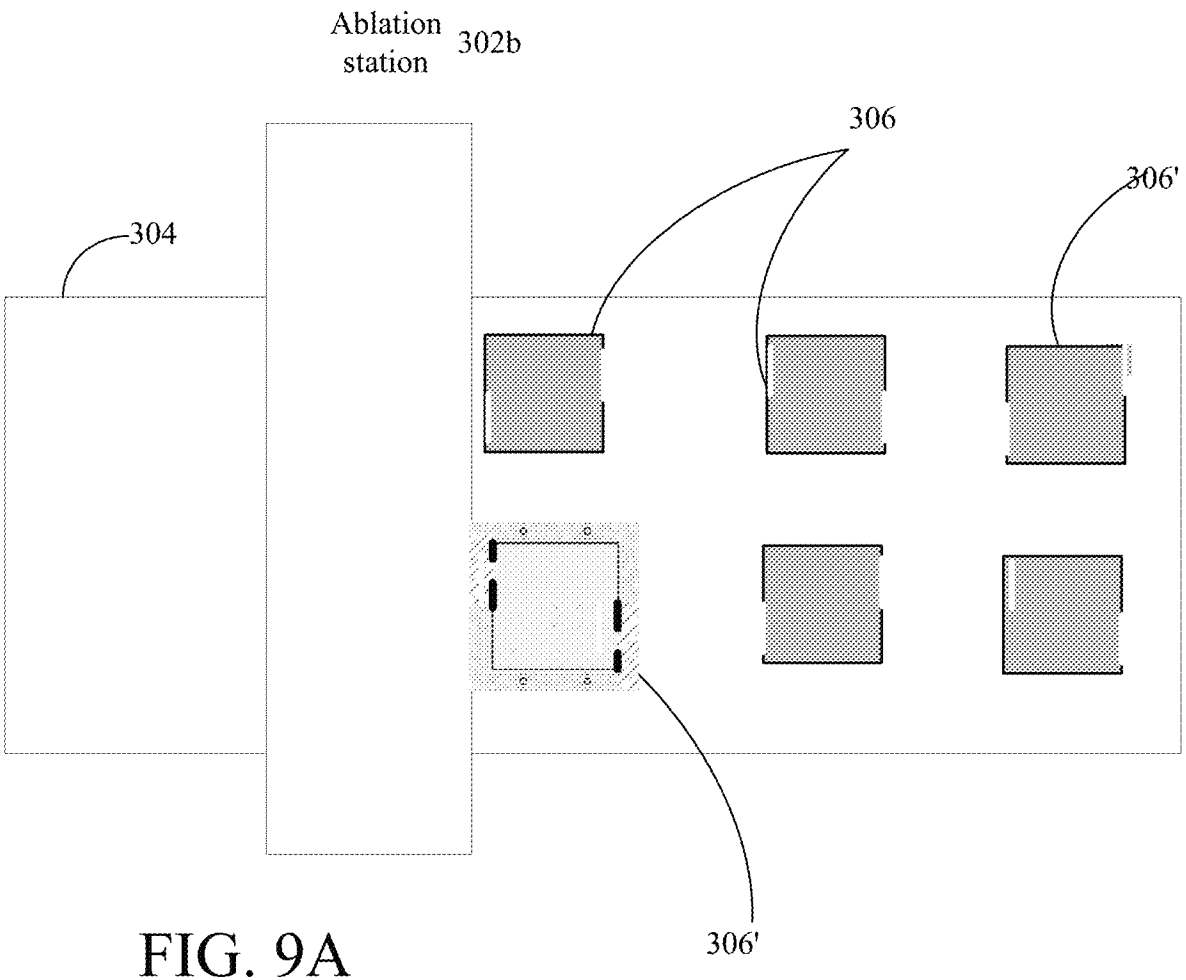
FIGS. 9A-9C are views of a roll to roll implementation for constructing valve less micro pump elements.
Figure 9B:
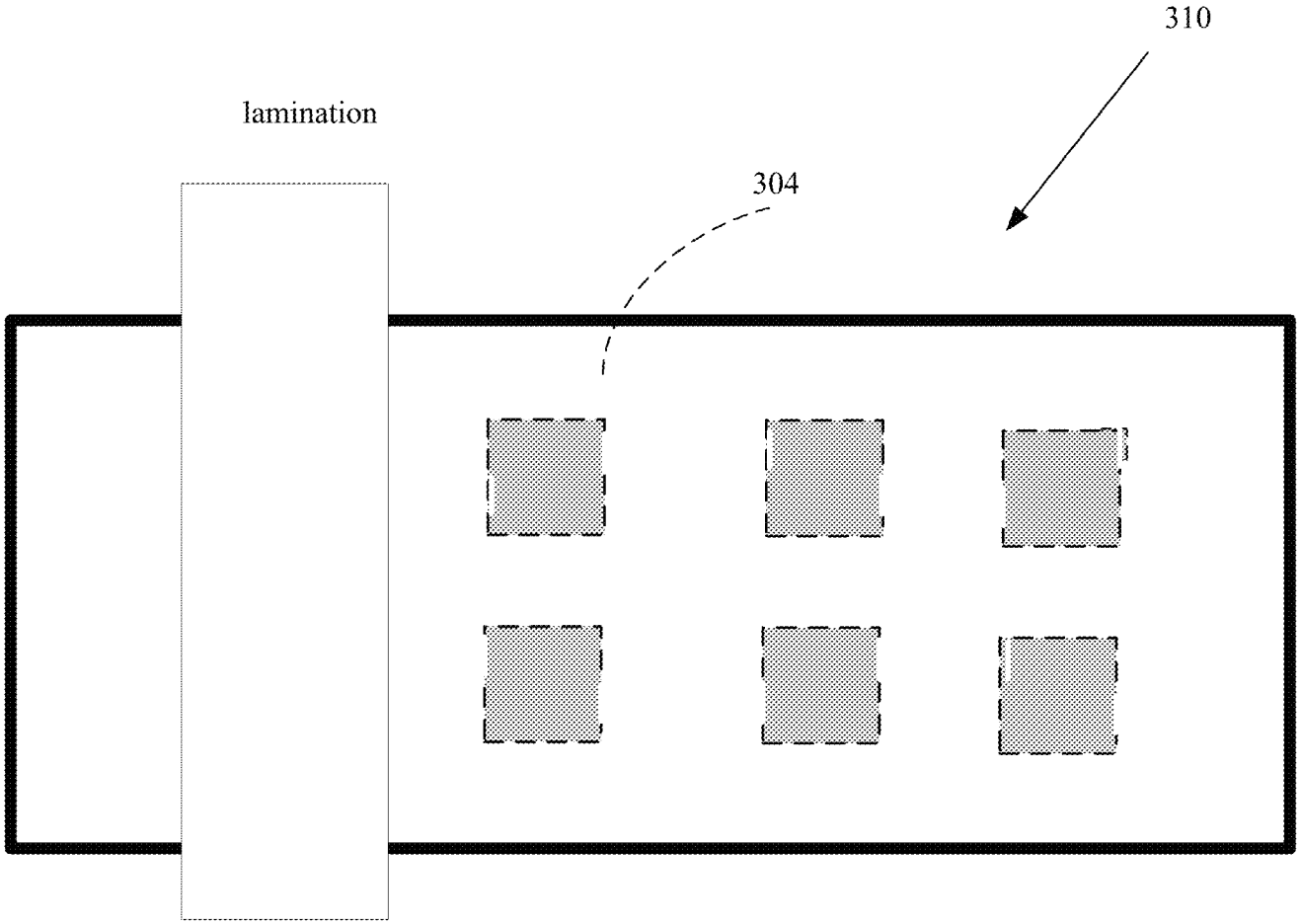
Figure 9C:
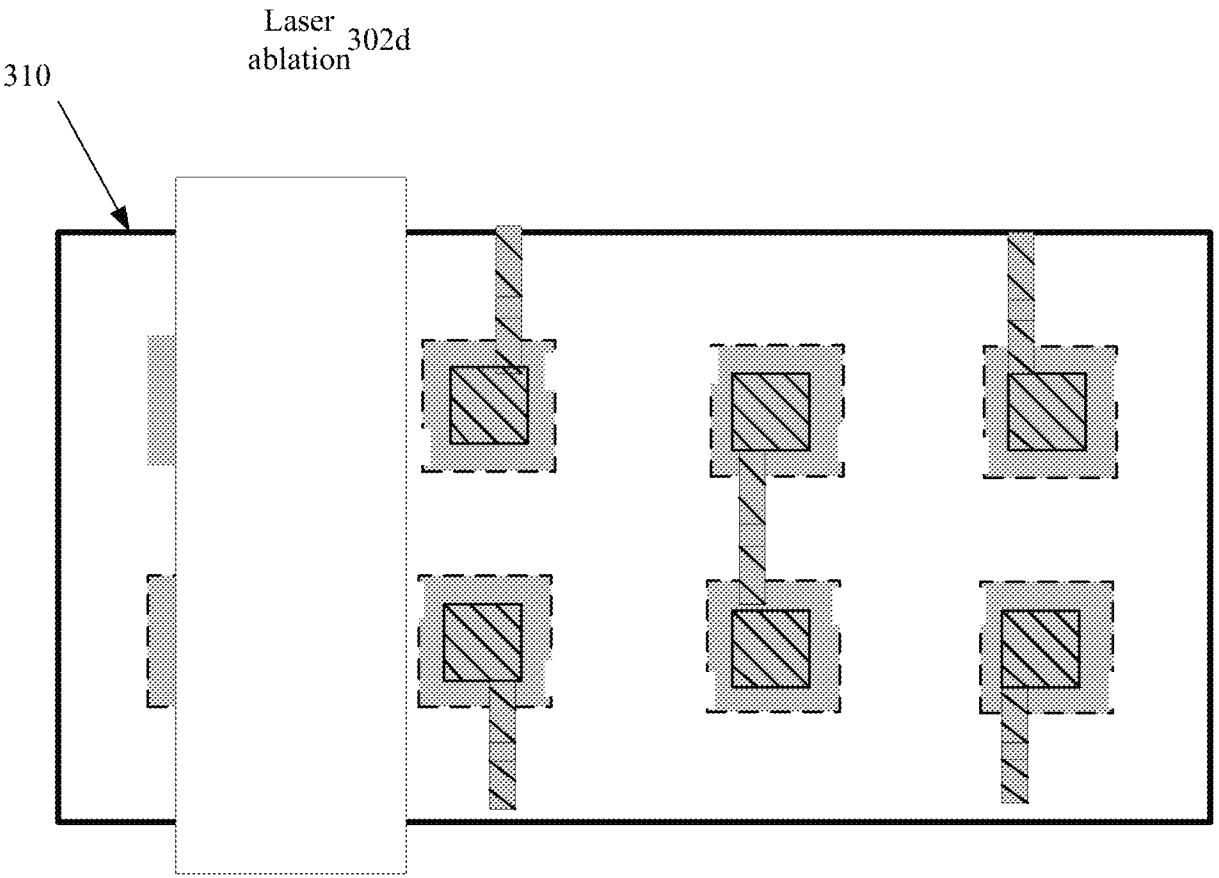

Referring to FIGS. 9A-9C, a roll to roll processing approach to provide the modularized micro pump is shown. The micro pump has features that are moveable in operation. i.e., the membrane (which flexes) and unobstructed passages into and out of chambers of the micro pump elements to provide valve functions when configured as discussed above. The micro pump is fabricated using roll to roll processing where a raw sheet (or multiple raw sheets) of material is passed through plural stations to have features applied to the sheet (or sheets) and the sheet (or sheets) are subsequently taken up to form parts of the repeatable composite layers to ultimately produce a composite sheet of fabricated micro-pumps.

Referring to FIG. 9A, a sheet 304 of a flexible material such as a glass or a plastic or a stainless steel is used as a web, e.g., the material is a plastic sheet, e.g., polyethylene terephthalate (PET). The sheet 304 is a 50 micron thick sheet of PET. Other thicknesses could be used (e.g., the sheet 304 could have a thickness between, e.g., 25 microns and 250 microns. The thicknesses are predicated on desired properties of the microelectromechanical system to be constructed and the handling capabilities of roll to roll processing lines.

These considerations will provide a practical limitation on the maximum thickness. Similarly, the minimum thicknesses are predicated on the desired properties of the microelectromechanical system to be constructed and the ability to handle very thin sheets in roll to roll processing lines.

For the example where the microelectromechanical system is the micro pump, the layers would have thicknesses as mentioned above approximately 50 microns for the pump body. However, other thicknesses are possible even for the micro pump. The sheet 304 from a roll (not shown) is patterned at an ablation station, e.g., a laser ablation station. A mask (not shown), (or a direct write process not shown), is used to configure the laser ablation station to remove material to define or form the compartments of the micro pump, as well as alignment holes (not shown but will be discussed below). Vias are also provided for electrical connections, as shown. The micro-machining ablates away the plastic to form the compartment of the micro pump while leaving the frame portion of the pump body and also forms the unobstructed passages for inlets and outlets.

Referring now to FIG. 9B, the sheet 304 with the defined features of the compartment and unobstructed passages is laminated at a lamination station to a second sheet 308, e.g., 5 micron thick sheet of PET, with a metallic layer 310 of Al of 100 A on a top surface of the sheet. This second sheet 308 forms the membranes over the pump bodies provided by the defined features of the compartment regions. The second sheet is also machined to provide the alignment holes (not shown) prior to or subsequent to coating of the metallic layer.

Prior to lamination of the second sheet 308 to the first sheet 304, the second sheet 308 is also provided with several dispersed holes (not shown) over some areas that will expose the pump bodies structures. These dispersed holes are used by a machine vision system to reveal and recognize underlying features of the pump body units on the first sheet 304. Data is generated by noting the recognized features in the first sheet through the holes. These data will be used to align a third ablation station when forming electrodes from the layer over the pump bodies (discussed below). The second sheet 308 is laminated to and thus sticks (or adheres) to the first sheet 304.

At this point, a composite sheet 310 of repeatable units of the micro pump, e.g., pump body and movable and releasable features, with membranes are formed, but without electrodes formed from the layer on the membrane. The machine vision system produces a data file that is used by the laser ablation system in aligning a third laser ablation station with a fourth mask (or direct write) such that a laser beam from the laser ablation system provides the electrodes 210 (FIG. 2B) according to the fourth mask, with the electrodes in registration with the corresponding portions of the pump bodies. The electrodes are formed by ablating away the metal in regions that are not part of the electrodes and conductors, leaving isolated electrodes and conductors on the sheet. The registration of the patterned electrodes to the pump body is thus provided by using the machine vision system to observe features on the front side (could also be the backside) of the laminated structure providing positioning data that the laser ablation system uses to align a laser beam with the fourth mask, using techniques commonly found in the industry.

Referring now to FIG. 9C, the composite sheet 310 is fed to a third laser ablation station to form the electrodes by ablating the 100 A° Al layer deposited on the second sheet that formed the membrane. The composite sheet 310 is patterned according to a fourth mask (or direct write) to define the electrodes over corresponding regions of the pump body. The third ablation station ablates away metal from the second layer leaving isolated electrodes on the sheet.

A jig (not shown) that can comprise vertical four posts mounted to a horizontal base is used to stack individual ones of cut units. On the jig an end cap (e.g., a 50 micron PET sheet with a metal layer) is provided and over the end cap a first repeatable unit is provided. The repeatable unit is spot welded (applying a localized heating source) (or laminated) to hold the unit in place on the jig. As each repeatable unit is stacked over a previous repeatable unit that unit is spot welded. The stack is provided by the inlets on one side and outlets one the opposing side. The passages can be staggered resulting from arrangement of the passages so as to have a solid surface separating each of the passages in the stack (See FIG. 3). Once a stack is completed, a top cap (not shown) can be provided. The stack unit is sent to a lamination station not shown, where the stack is laminated, laminating all of the repeatable units and caps together. The end cap and top cap can be part of the packaging as well. Otherwise, repeatable units can be laminated one or a few layers of a time. An electrode is attached to the pump end cap for activating the compartment. The electrode includes a lead (not shown) to connect to a drive circuit (not shown). After lamination of the stack, the stack units are diced to form individual micro pumps.

Other stacking techniques for assembly are possible with or without the alignment jig, pin or holes.

Elements of different implementations described herein may be combined to form other embodiments not specifically set forth above. Elements may be left out of the structures described herein without adversely affecting their operation. Furthermore, various separate elements may be combined into one or more individual elements to perform the functions described herein. Other embodiments are within the scope of the following claims. For example, a micro pump may include a micro pump element that includes a pump body having walls that enclose a pump chamber, a plurality of inlet ports with unobstructed fluid ingress into the pump chamber and a plurality of outlet ports with unobstructed fluid egress from the pump chamber, top and bottom caps on opposing portions of the pump body, plural membranes that compartmentalized the pump chamber to provide plural compartments in the pump chamber, with each of the plurality of membranes carrying on a major surface thereof three mutually electrically isolated electrode elements that cause the membrane to undulate according to different phases of signals applied successively to the mutually electrically isolated electrode elements.

What is claimed is:

1. A micro pump comprises:

a plurality of micro pump elements, each micro pump element comprising:

a pump body having walls and a pair of end caps that together with the walls of the pump body enclose a pump chamber that is compartmentalized into plural compartments, a plurality of inlet ports each with unobstructed fluid ingress into corresponding ones of the plural compartments and a plurality of outlet ports each with unobstructed fluid egress from corresponding ones of the plural compartments;

a plurality of flexible membranes comprised of a flexible material, the plurality of membranes disposed in the pump chamber, with the plurality of membranes affixed to the walls of the pump body, and which compartmentalize the chamber to provide the plural compartments; and a plurality of electrodes, with a first pair of the plurality of electrodes disposed on a pair of opposing walls of the pump body, and each remaining one of the plurality of electrodes being disposed on a single major surface of a corresponding one of the plurality of membranes;

with the plurality of micro pump elements arranged in a series connected configuration having outlet ports of a first one of the plurality of micro pump elements fluidly connected to inlet ports of an immediately adjacent one of the plurality of micro pump elements.

2. The micro pump of claim 1 wherein the plurality of micro pump elements includes an input element, a pump element and an output element.

3. The micro pump of claim 1 wherein the plurality of micro pump elements are modularized micro pump elements.

4. The micro pump of claim 1 wherein the inlet ports and outlet ports are on opposing walls of the pump body of each of the micro pump elements.

5. The micro pump of claim 1 wherein the inlet ports and the outlet ports are on opposing walls of the pump body, the inlet ports of a first one of the micro pump elements configured to connect to a source of fluid and the outlet ports of a last one of the micro pump elements is configured to connect to a sink to store pressurized fluid from the micro pump.

6. The micro pump of claim 1 further comprising:

a drive circuit to supply voltage signals to the plurality of electrodes, which voltage signals cause a first pair of adjacent membranes to deflect towards each other to obstruct fluid flow in a first corresponding compartment and a second pair of adjacent membranes to deflect away from each other to provide unobstructed fluid flow in a second, different corresponding compartment.

7. The micro pump of claim 1 further comprising:

voltage driver circuitry to produce voltage signals that are fed to the plurality of electrodes;

with a first set of the voltage signals to cause in a first one of the plurality of micro pump elements, a first one of the plural compartments to compress and at least one adjacent one of the plural compartments to expand; and with a second set of the voltage signals applied with the first set to cause in a second, adjacent one of the plurality of micro pump elements a first one of the plural compartments to expand and at least one adjacent one of the plural compartments to compress.

8. The micro pump of claim 1 further comprising:

voltage driver circuitry to produce voltage signals that are fed to the plurality of electrodes according to a sequence.

9. The micro pump of claim 8 wherein the sequence is a peristaltic sequence.

10. The micro pump of claim 9 wherein the peristaltic sequence has six phases.

11. The micro pump of claim 10 wherein the six phases of the peristaltic sequence are for the plurality of micro pump elements consisting essentially of an input element, a pump element and an output element:

011
001
101
100
110
010 with 0 corresponding to a first one of open or close of a compartment, 1 corresponding to a second, different one of open or close of a compartment and each of the phases having the values for respectively the input element, the pump element and the output element.

12. The micro pump of claim 1 wherein the walls of the pump body have internal tapered edges within each of the respective compartments.

13. The micro pump of claim 12 wherein the tapered edges have a pair of tapers that are at a slope selected to make contact with corresponding one of the membranes when the membranes flex.

14. The micro pump of claim 12 wherein the tapered edge portions have a substantially equilateral triangular, solid shape.

15. The micro pump of claim 1 consisting essentially of three micro pump elements connected together in the series configuration, where outlets of a first micro pump element are fluidly connected to inlets of an adjacent, succeeding micro pump element.

16. The micro pump of claim 1 wherein the micro pump is a valve-less micro pump.

17. The micro pump of claim 1 further comprising:

voltage driver circuitry to produce voltage signals that are fed to the plurality of electrodes according to a selectable pair of first and second peristaltic sequences, with each of the first and second peristaltic sequences having six phases and each of the micro pump elements has plural compartments and for the plurality of micro pump elements consisting essentially of an input element, a pump element and an output element, respectively, the first peristaltic sequence is:

011
001
101
100
110
010 and the second, different peristaltic sequence is:

100
110
010
011
001
101 with "0" being a logic value corresponding to a first one of open or close of a compartment, "1" being a logic value corresponding to a second, different one of open or close of a compartment and each of the phases having the values for respectively the input element, the pump element and the output element.

18. The micro pump of claim 1 wherein the plurality of micro pump elements arranged in the series connected configuration, with the outlets of the first micro pump element connected to the inlets of the immediately adjacent one of the plurality of micro pump elements, and with inlets of a second micro pump element connected to the outlets of the intermediate micro pump element, with outlets of the second micro pump element providing outlets of the micro pump.

19. The micro pump of claim 1 wherein the plurality of micro pump elements is a first plurality of micro pump elements, and the plurality of micro pump elements includes a plurality of intermediate micro pump elements, with the first plurality of micro pump elements arranged in the series connected configuration, with the outlets of the first micro pump element coupled to the inlets of a first one of the plurality of intermediate micro pump elements, and outlets of a last one of the plurality of intermediate micro pump elements coupled to the inlets of a second micro pump element, with the outlets of the second micro pump element providing the outlets of the micro pump.

20. The micro pump of claim 1 wherein the plurality of micro pump elements includes an input element, a second plurality of pump elements, and an output element.

21. The micro pump of claim 20 wherein each of the plurality of micro pump elements is a modularized micro pump element, and each of the micro pump elements includes a pair of end caps that together with the walls of the pump body form the chamber.

* * * * *